US006401261B1

(12) United States Patent
Arney et al.

(10) Patent No.: US 6,401,261 B1
(45) **Date of Patent: *Jun. 11, 2002**

(54) SIZING AND STABILIZING APPARATUS FOR BICYCLE HELMETS

(75) Inventors: Michel D. Arney, Needham; Andrew G. Zeigler, Arlington; Thomas H. Burchard, Winchester; Terrence K. Jones, Sharon, all of MA (US)

(73) Assignee: Bell Sports, Inc., San Jose, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/280,254

(22) Filed: Mar. 29, 1999

Related U.S. Application Data

(63) Continuation of application No. 08/432,123, filed on May 17, 1995, now Pat. No. 5,887,288, which is a continuation-in-part of application No. 08/088,878, filed as application No. PCT/US94/07643 on Jul. 8, 1994, now Pat. No. 5,659,900.

(51) Int. Cl.[7] ..... A42B 3/08
(52) U.S. Cl. ..... 2/421; 2/425
(58) Field of Search ..... 2/410, 411, 414, 2/415, 416, 417, 418, 421, 422, 425

(56) References Cited

U.S. PATENT DOCUMENTS

| | | | | |
|---|---|---|---|---|
| 1,522,024 A | | 1/1925 | Nixon, Jr. | 2/421 |
| 1,522,952 A | | 1/1925 | Goldsmith | 2/414 |
| 1,537,178 A | | 5/1925 | Maynard | 2/421 |
| 2,769,176 A | | 11/1956 | Grancsay et al. | 2/421 |
| 2,814,043 A | | 11/1957 | Alesi | 2/421 |
| 3,087,166 A | | 4/1963 | Howard | 2/420 |
| 3,103,014 A | | 9/1963 | Morgan | 2/415 |
| 3,139,623 A | * | 7/1964 | Joseph, Jr. | 2/415 |
| 3,230,544 A | * | 1/1966 | Mager | 2/415 |
| 3,354,468 A | | 11/1967 | Bowers | 2/421 |
| 3,388,405 A | | 6/1968 | Simpson et al. | 2/418 |
| 3,510,879 A | | 5/1970 | Webb | 2/416 |
| 3,609,763 A | | 10/1971 | Raney | 2/415 |
| 3,873,997 A | | 4/1975 | Gooding | 2/413 |
| 3,934,271 A | | 1/1976 | Rhee | 2/424 |
| 3,991,423 A | * | 11/1976 | Jones | 2/415 |
| 3,992,722 A | | 11/1976 | Rhee | 2/424 |
| 4,000,520 A | | 1/1977 | Svendsen et al. | 2/418 |
| 4,058,854 A | | 11/1977 | Rhee | 2/412 |
| 4,068,323 A | | 1/1978 | Gwon | 2/413 |
| 4,263,679 A | | 4/1981 | Erlendson | 2/421 |
| 4,279,038 A | | 7/1981 | Bruckner et al. | 2/425 |
| 4,319,362 A | | 3/1982 | Ettinger | 2/415 |
| 4,477,929 A | | 10/1984 | Mattsson | 2/425 |

(List continued on next page.)

FOREIGN PATENT DOCUMENTS

| | | |
|---|---|---|
| DE | 36 32 525 A1 | 9/1986 |
| GB | 1144682 | 3/1969 |
| GB | 2 021 387 | 12/1979 |
| GB | 2 177 893 A | 2/1987 |

*Primary Examiner*—Michael A. Neas
(74) *Attorney, Agent, or Firm*—Womble Carlyle Sandridge & Rice

(57) ABSTRACT

A bicycle helmet is disclosed having a flexible, articulated member being resiliently flexible to provide resilient forward pressure against an inwardly curved portion on the posterior of a wearer's head and a flexible connection between the articulated member and opposite sides of the shell assembly including at least one elastically elongatable strap portion for providing additional resilient forward pressure against the wearer's head.

10 Claims, 19 Drawing Sheets

U.S. PATENT DOCUMENTS

| | | | | |
|---|---|---|---|---|
| 4,534,068 | A | | 8/1985 | Mitchell et al. ..... 2/414 |
| 4,796,309 | A | | 1/1989 | Nava ..... 2/414 |
| 4,884,301 | A | | 12/1989 | Aileo ..... 2/421 |
| 5,012,533 | A | | 5/1991 | Raffler ..... 2/420 |
| 5,079,780 | A | | 1/1992 | Coombs et al. ..... 2/420 |
| 5,121,508 | A | | 6/1992 | Grilliot et al. ..... 2/421 |
| 5,142,705 | A | | 9/1992 | Edwards ..... 2/418 |
| 5,638,551 | A | * | 6/1997 | Lallemand ..... 2/421 |
| 5,704,072 | A | * | 1/1998 | Garneau ..... 2/421 |
| 5,774,901 | A | * | 7/1998 | Minami ..... 2/421 |
| 5,794,272 | A | * | 8/1998 | Workman et al. ..... 2/421 |
| 5,829,065 | A | * | 11/1998 | Cahill ..... 2/418 |

* cited by examiner

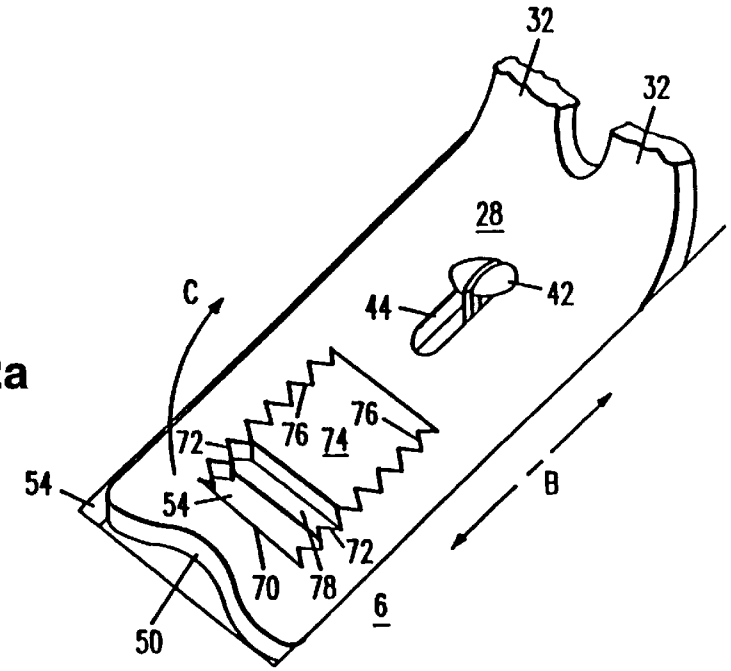
FIG. 12b
FIG. 12a
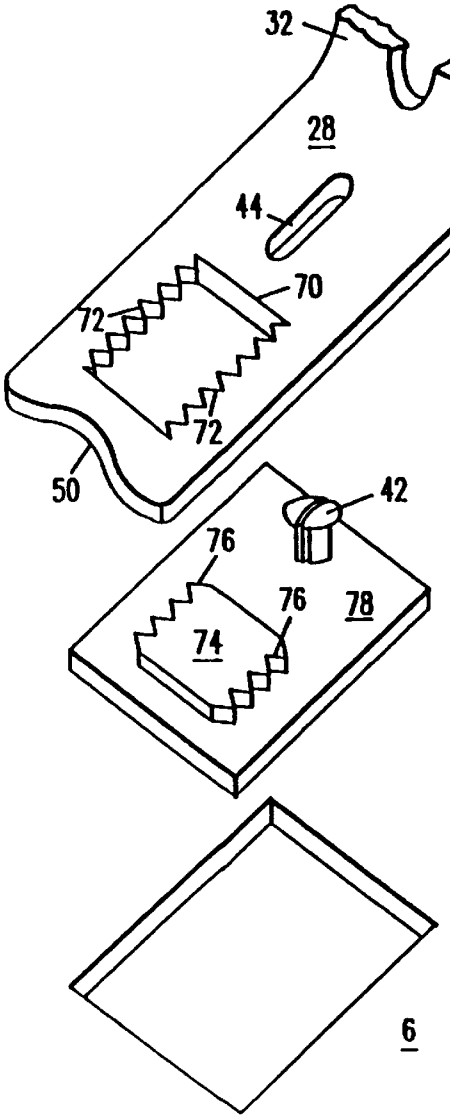

SIZING AND STABILIZING APPARATUS FOR BICYCLE HELMETS

RELATED APPLICATIONS

This application is a continuation of U.S. application Ser. No. 08/432,123, filed May 17, 1995 (now U.S. Pat. No. 5,887,288, issued Mar. 30, 1999), which was a continuation-in part of U.S. application Ser. No. 08/088,878, filed Jul. 8, 1993 (now U.S. Pat. No. 5,659,900, issued Aug. 26, 1997), though PCT Application PCT/US94/07643, filed Jul. 8, 1994.

BACKGROUND OF THE INVENTION

1. Field of the Invention

The present invention relates to bicycle helmets, in particular to sizing to and stabilizing a mountain bike helmet on a rider's head.

2. Discussion of the Prior Art

Lightweight helmets for head protection during bicycle riding falls and accidents have continuously evolved and undergone numerous improvements in recent years. One particular area of refinement has been in the fitting and stabilizing of helmets on the bicycle rider's head. An example of a prior art bicycle helmet and a means for securing it from excessive movement is disclosed in U.S. Pat. No. 4,903,350.

In order to fit a variety of head shapes and sizes, a particular brand of helmet often will be available in several sizes. Each size typically can be customized to a particular wearer's head by inserting or removing cushions and pads around the interior of the helmet cavity to obtain a snug fit.

Chin straps are employed to keep the helmet on. These straps reduce the vertical movement of the helmet relative to the wearer's head, but provide little resistance to the forward and back rocking motion of the helmet. Many helmet models now employ chin straps having a "Y" configuration on each side. A loop is attached to the front and rear of each side of the helmet, and these two loops are connected by a strap beneath the wearer's chin. An example of this type of prior art helmet and strap arrangement is also disclosed by U.S. Pat. No. 4,903,350. While this type of chin strap reduces the amount of helmet movement, it does not eliminate it.

The sport of mountain bike riding has grown increasingly popular in recent years. This activity involves riding specially designed bicycles with heavy duty frames and components on unpaved roads, trails and rough terrain. Experienced mountain bike riders can travel over steep drops, uneven terrain, boulders, stumps, logs, creek beds, and such while on their mountain bikes. Conventional bicycle helmets are typically used for protection from falls. The bouncing, bumping and jarring associated with mountain bike riding greatly exacerbates the problem of excessive helmet movement on the riders head. Bike riders traveling on dirt roads or even city streets will often experience these problems. A tightly fitted helmet with a taut chin strap may reduce the amount of movement of the helmet on the wearers head, but usually provides more of a discomfort than a solution to the problem.

Prior art bicycle helmets have not utilized the undercut portion beneath the occipital region of the wearer's head to stabilize the helmet. There are two apparent reasons for this. The first is that the process used to mold a one piece main shell of the helmet can not tolerate a negative draft angle without prohibitively expensive multi-part molds to allow removal of the helmet after molding. The second reason concerns the difficulty or impossibility of the wearer fitting the helmet over his or her head if the helmet contains a substantial inward curve to match the undercut portion of the back of the head.

SUMMARY OF THE INVENTION

Broadly stated, the present invention, to be described in greater detail below, is directed to a bicycle helmet having an articulated member for engaging the head of the wearer.

In accordance with one aspect of the present invention, an articulated member is biased against the occipital region of the wearer's head, allowing the helmet to more closely fit a larger range of head sizes and shapes.

In accordance with another aspect of the present invention, the occipital region of the wearer's head is elastically retained between a rear articulated member and the inside of the main shell portion of the helmet. Because the occipital region is cradled from both above and below, the helmet is comfortably secured and movement of the helmet on the wearer's head is greatly reduced or eliminated.

BRIEF DESCRIPTION OF THE DRAWINGS

FIGS. 12*a* and 12*b* are perspective views showing a sliding adjustment and locking feature for the articulated member of an alternative embodiment.

DETAILED DESCRIPTION OF THE PREFERRED EMBODIMENTS

Figure 1:
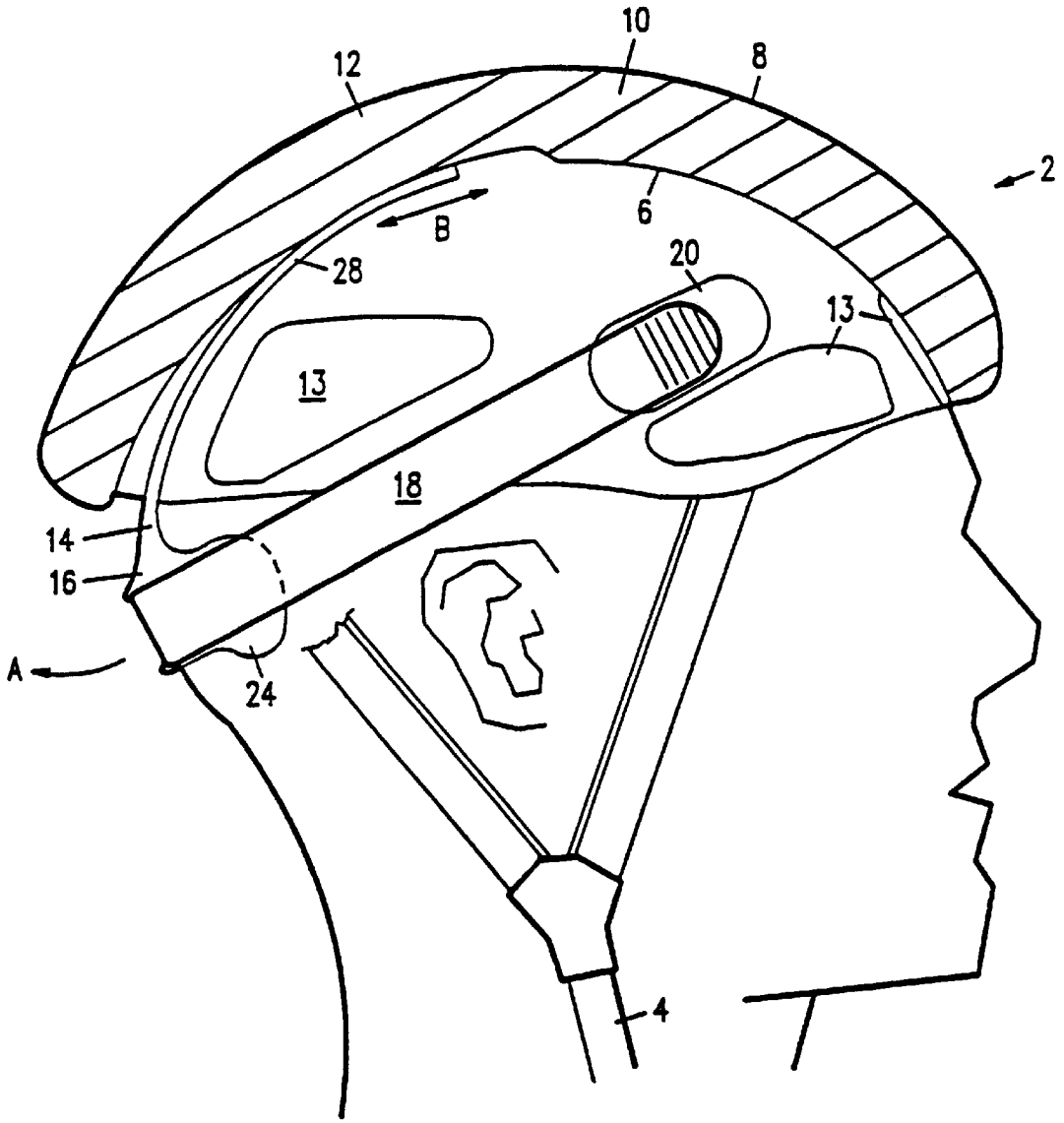
FIG. 1 is a fragmentary side elevation view showing a general embodiment of the inventive helmet.

Referring to FIG. 1, in which the general embodiment of the present invention is shown, the main shell 2 of the helmet is secured to the wearer's head by a chin strap 4. The main shell 2 has an interior surface 6 defining a helmet cavity for receiving the wearer's head, and an exterior surface 8. The helmet can be further defined by a top portion fitting over the top of the head of a wearer and with a front half 10 and a rear half 12. Removable pads 13 are attached to the central top interior surface 6 of main shell 2 for obtaining a proper fit for a particular wearer. A flexible articulated member 14 is attached to the interior 6 of the top portion of the main shell 2 forward of the back of the neck of a wearer near the front of the shell rear half 10 and extends downward and inward, generally along the interior surface 6 of the rear half 12 and extending beyond the lower edge of the helmet. In the general embodiment, when the articulated member 14 is in a relaxed state when the helmet is not being worm, articulated member 14 curves inward more than shown in FIG. 1. As the helmet is placed on the wearer's head, articulated member 14 flexes rearward in the direction of arrow A to accommodate the head, then returns partially forward underneath the occipital region of the head when the helmet is all the way on. The flexing portion of the articulated essentially forms a hinge that allows the wearer to flex the articulated member back to allow the helmet to fit over the wearer's head. Once the helmet is on, the articulated member 14 flexes forward again to contact the back of the head. Because articulated member 14 is being displaced when worm, it exerts a forward pressure on the back of the head. The flexed portion of the displaced articulated arm 14 acts as a spring to exert the forward pressure on the back of the head. This forward pressure provides a snug yet comfortable fit which greatly increases the stability of the helmet. Because the occipital region of the wearer's head is cradled from below by the articulated member 14, the helmet is restrained from rocking forward and back, and from bouncing around on the wearer's head.

Figure 2:
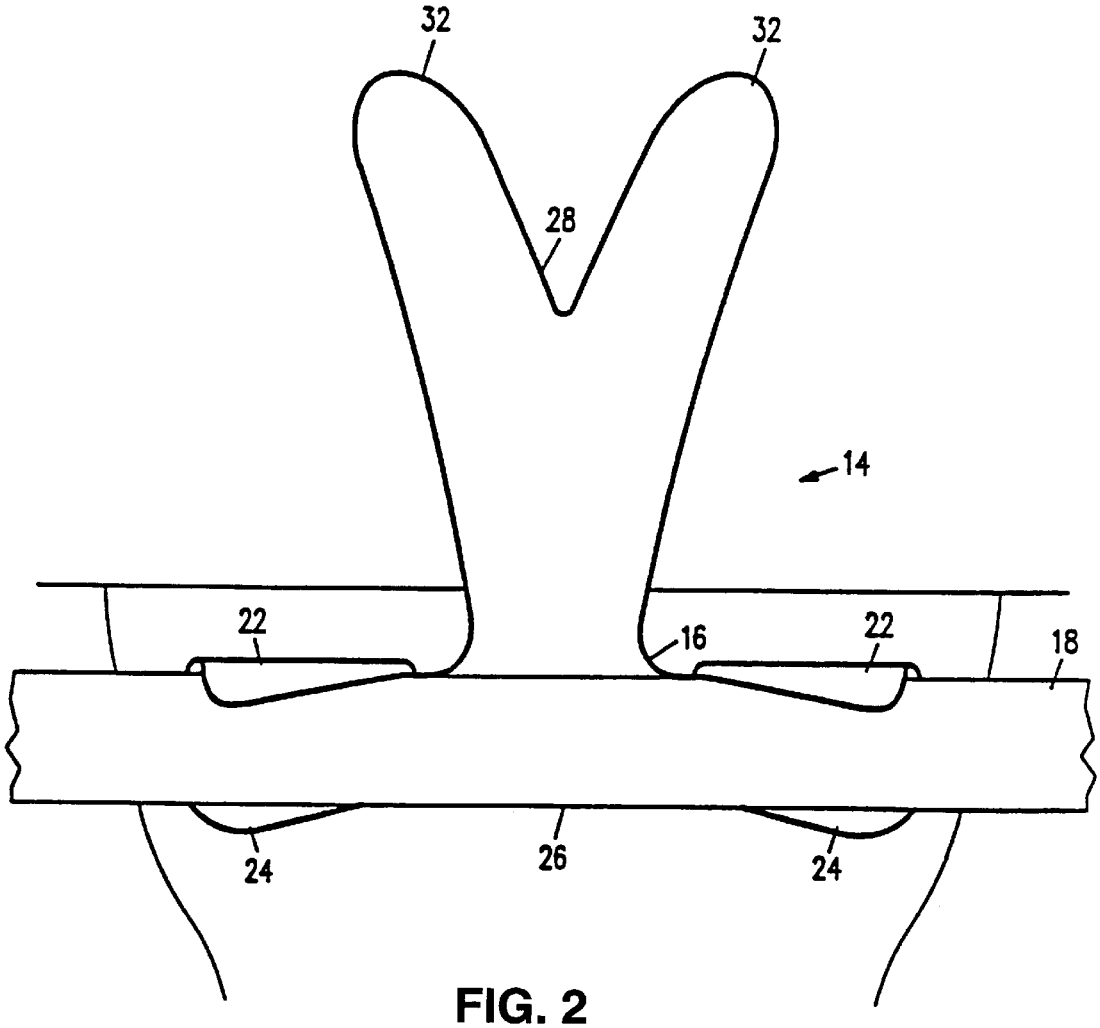
FIG. 2 is a rear elevation view showing the articulated member of a general embodiment.

FIG. 2 shows the T-shaped distal end 16 of articulated member 14. The distal end 16 of the articulated member 14 is also curved in a lateral direction. The curvature in this direction is designed to approximate the curvature of the corresponding portion of the wearer's head, and if necessary, to flex in the lateral direction to accommodate the head.

An elastic strap 18 is provided to increase, and preferably also to adjust, the forward pressure exerted by the flexed articulated member 14 against the back of the user's head. In the general embodiment shown in FIGS. 1 and 2, a one piece strap 18 is attached at both its ends to the interior 6 of the sides of the main shell 2. The middle portion of strap 18 is guided across the back of the distal end 16 of articulated member 14. When the helmet is worm, strap 18 stretches, thereby adding to the forward flexing force of the articulated member 14. The location of the attachment points on the main shell 2 is such that the strap 18 biases the distal end 16 of articulated member 14 upward and inward against the inwardly curving portion of the occipital region of the wearer's head.

In the general embodiment, strap 18 is attached at both ends to the main shell 2 with hook and loop type fasteners. The preferred embodiment uses VELCRO® hook and loop type fasteners. A small patch 20 of the hook portion of the fastener is bonded to each side of the main shell 2 on the interior surface 6 just above and forward of the wearer's ears. The entire strap 18 is made from an elastic fabric with a nap suitable for releasably adhering to patches 20 inside the main shell 2. The forward and upward tension that the strap 18 imparts to the wearer's head through the articulated member 14 can be increased or decreased by moving one or both ends of the strap 18 forward or back, respectively, in relation to the patches 20. This is done with the helmet off in the general embodiment. Alternatively, one end of the strap 18 can be made adjustable, with the other end being fixed.

Figure 6:
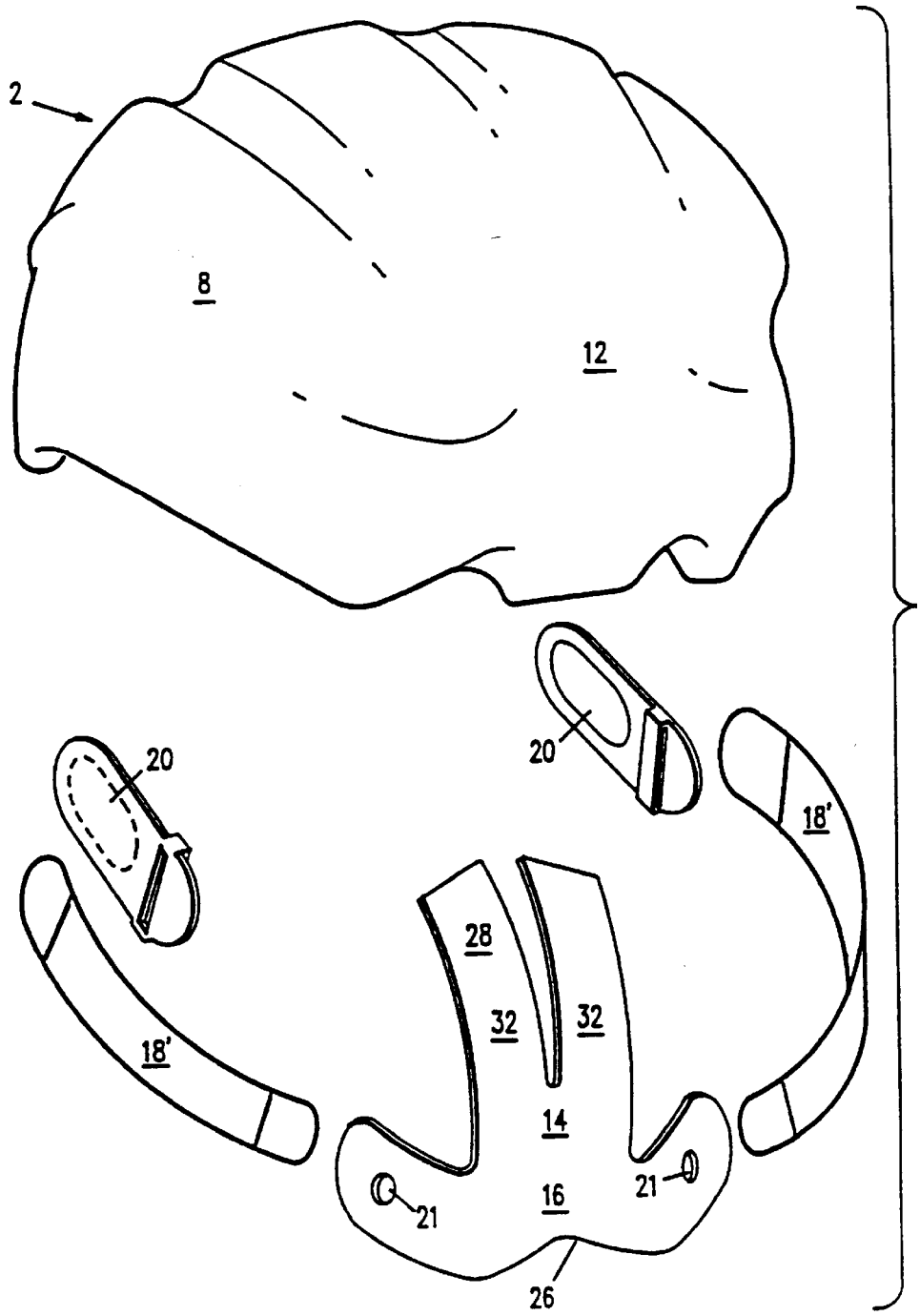
FIG. 6 is an exploded rear perspective view showing an alternate embodiment.

In an alternative embodiment, shown in FIG. 6, two straps 18' can be used, with each strap 18' spanning between one side of the distal end 16 of the articulated member 14 and the adjacent side of the main shell 2. The straps 18' can be attached with snaps 21 to the distal end 16 of the articulated member 14. The opposite ends of straps 18' are then adjustably attached to the main shell 2 in a similar manner to that previously described. In another variation of the two strap embodiment (not shown), one end of each strap is attached to the inside of the helmet, while the other end is adjustably attached to the distal end 16 of the articulated member 14, allowing the strap tension to be adjusted while the helmet is being worn.

Figure 5:
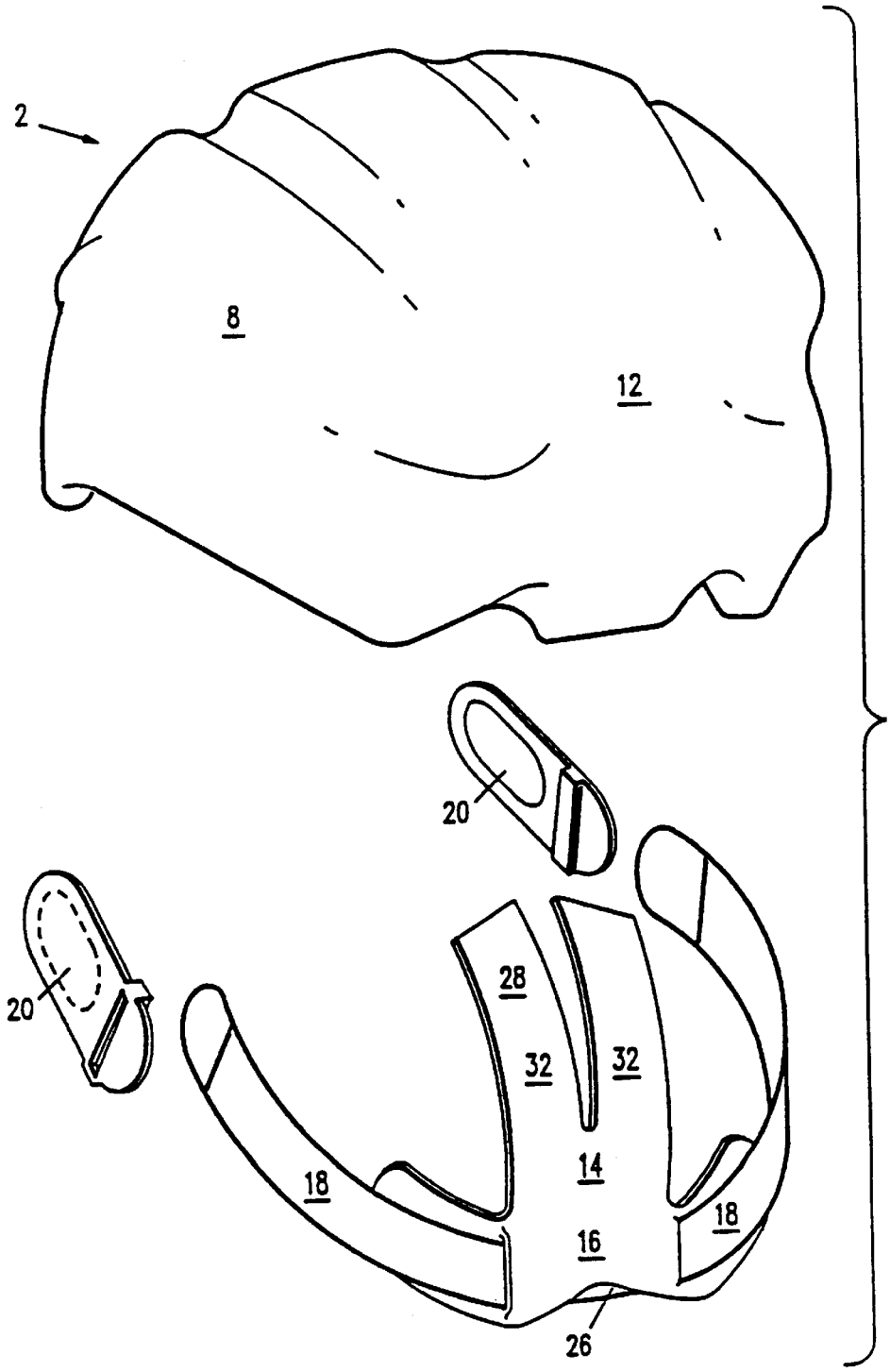
FIG. 5 is an exploded rear perspective view showing an alternate embodiment.
Figure 7:
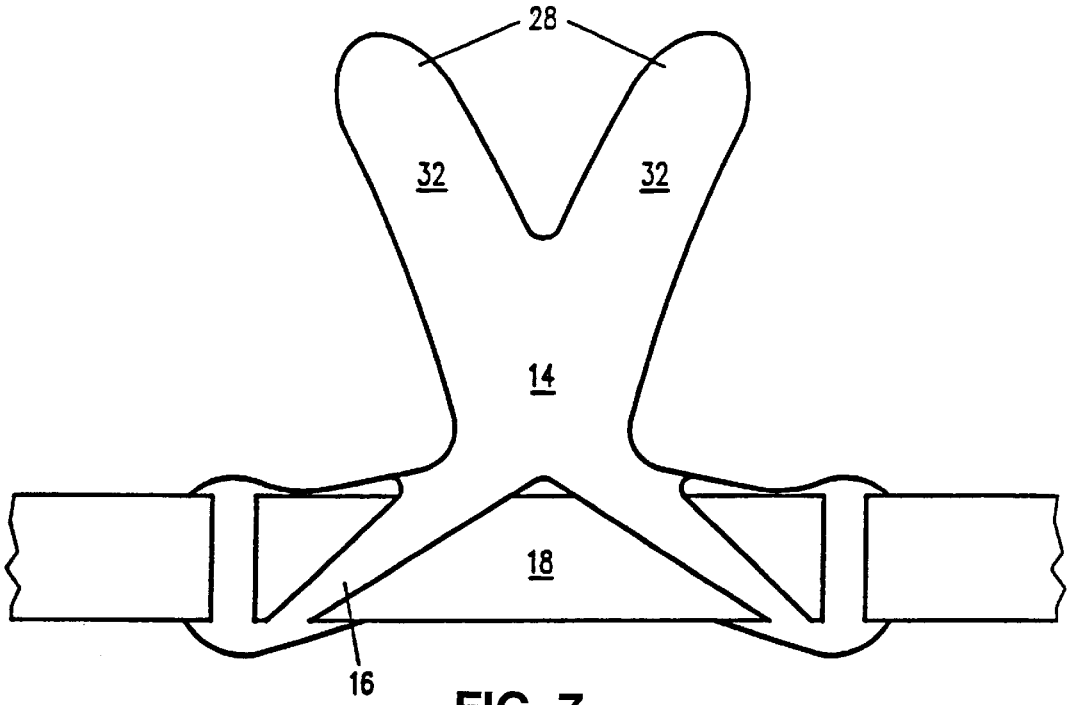
FIG. 7 is a rear elevation view showing the articulated member of an alternate embodiment.
Figure 8:
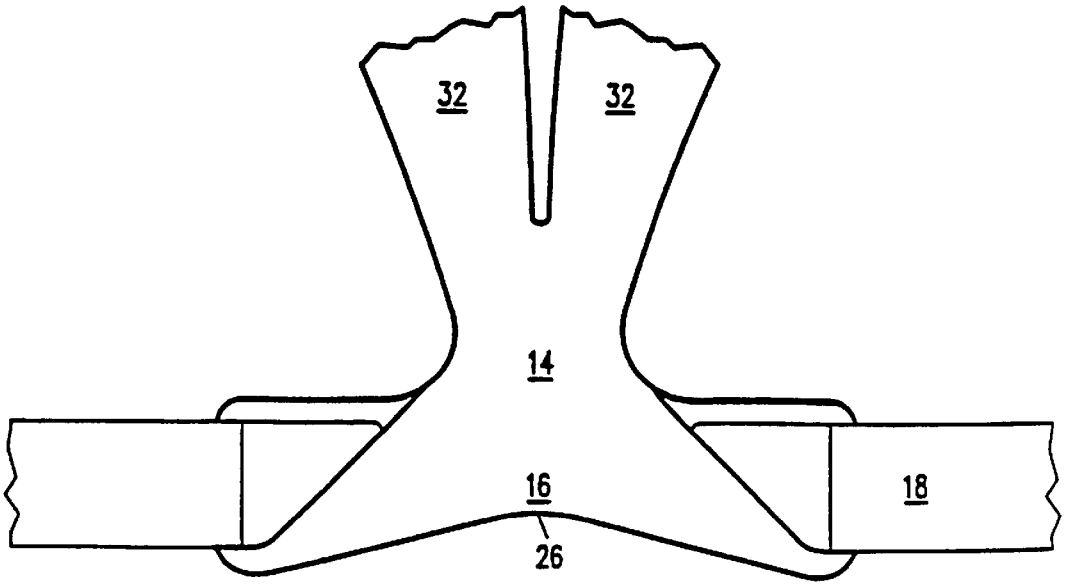
FIG. 8 is a rear elevation view showing the articulated member of an alternate embodiment.

In the general embodiment shown in FIG. 2, inverted J-shaped hold downs 22 are provided on the upper outside ends of the T-shaped distal end 16 of the articulated member 14. These hold downs 22 capture the upper edge of strap 18 and prevent it from sliding upwards and off the T-shaped distal end 16 of the articulated member 14. Similarly, outward bends 24 are provided near the lower edge of articulated member 14 to inhibit strap 18 from sliding off the bottom of articulated member 14. In alternative embodiments, strap 18 can be captivated by clips or guide slots in the distal end 16 of the articulated member 14, as shown in FIGS. 5, 7 and 8.

As shown in FIGS. 1 and 2, outward bends 24 also serve to comfortably guide the leading edge (lower edge) of the articulated member 14 over the head when the wearer puts the helmet on. Recess 26 is provided at the lower edge of the articulated member 14 to accommodate the wearer's neck (or hair, such as when worn in a ponytail) when the wearer is in a forward leaning, bicycle riding position. Recess 26 and outward bends 24 allow articulated member 14 to comfortably exert a constant forward and upward pressure on the occipital region of the wearer's head without binding or digging in, regardless of the front to back tilt of the wearer's head.

Figure 3:
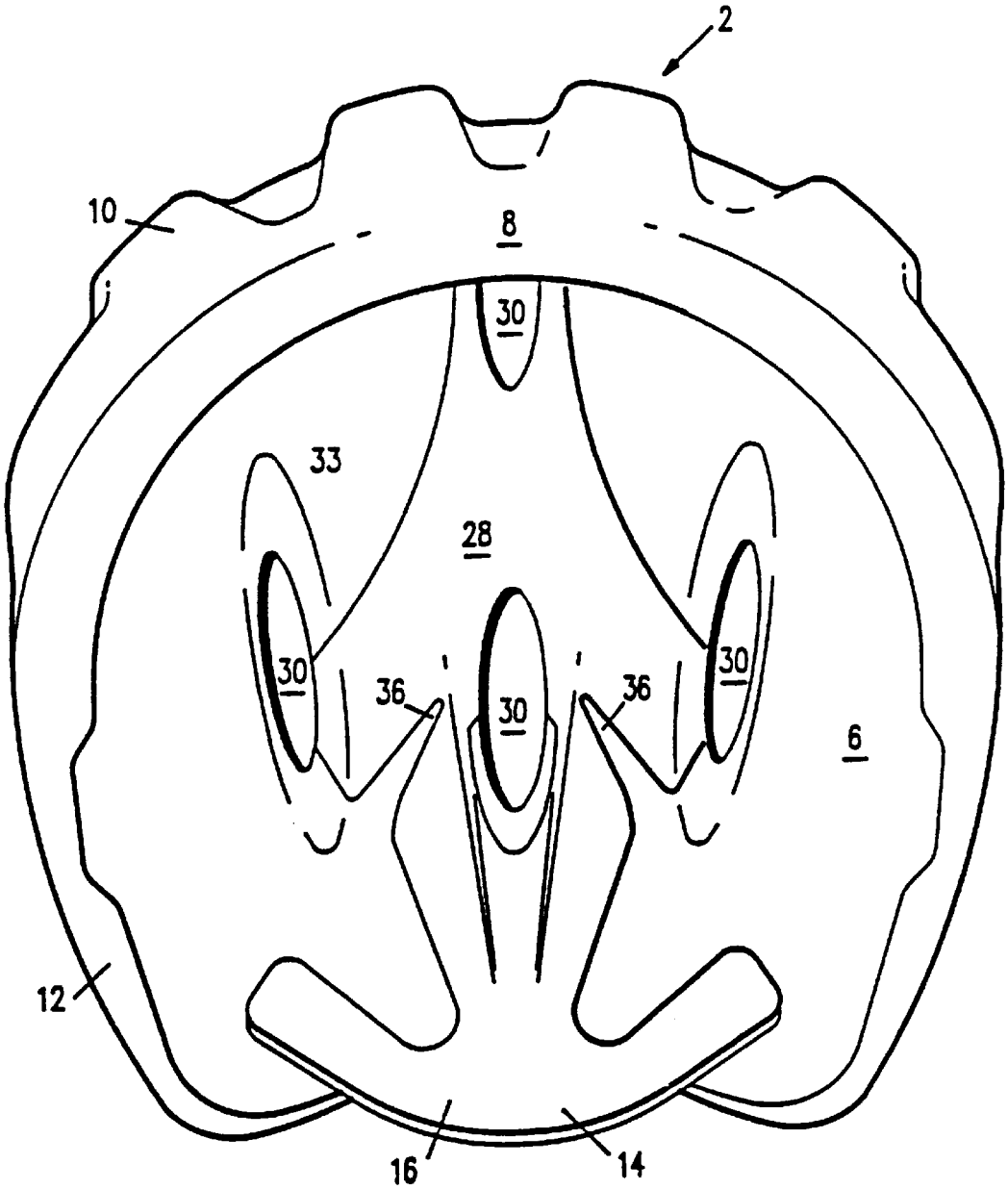
FIG. 3 is a lower frontal view showing the articulated member up inside the main shell in an alternative embodiment.

In the general embodiment, as shown in FIG. 2, the proximal end 28 of the articulated member 14 is forked so that it can be securely mounted to the interior 6 of the main shell 2 without interfering with the air flow through the air vents 30. Both tines 32 of proximal end 28 of articulated member 14 are attached to the interior 6 of the main shell 2 with fasteners or adhesive. Air vents 30 in the main shell 2 can be utilized to secure complementary tabs 33 on the articulated member 14, as shown in FIG. 3.

Figure 4:
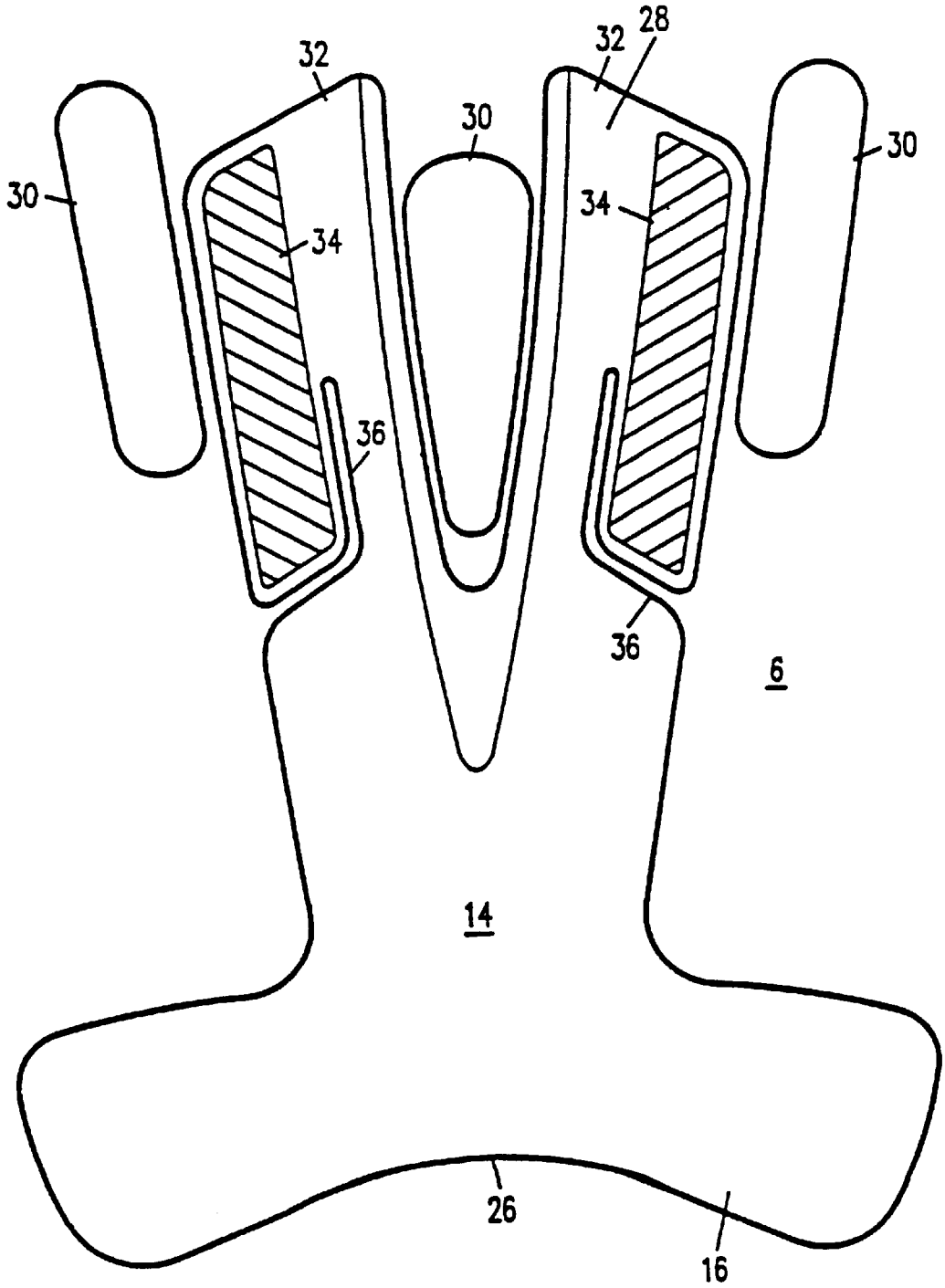
FIG. 4 is an enlarged, partial bottom view showing the articulated member in an alternative embodiment.

In an alternative embodiment shown in FIG. 4, the proximal end 28 of articulated member 14 is attached to the main shell 2 with an adhesive tape 34. Adhesive tapes offer excellent bonding strength when in tension, but are susceptible to peeling off when force is concentrated on one comer or edge. Reliefs 36, which are elongated cutouts in the articulated member 14, are provided in the proximal end 28 of the articulated member 14 to more centrally locate the force which is applied to the adhesive tape 34 when the articulated member 14 is flexed. This arrangement more evenly distributes the forces that would tend to separate the articulated member 14 from the main shell 2. Without the reliefs 36, articulated member 14 might be peeled off the main shell 2 by pushing the articulated member 14 forward, or from cycling back and forth due to prolonged use. The reliefs 36, however, ensure that the articulated member 14 remains adhered to the main shell 2 because the adhesive tape 34 is exposed to mostly tensile stress and low peel stress.

As shown in FIG. 1, an alternative embodiment can include the ability to adjust articulated member 14 in the direction of arrow B. The articulated member 14 can be slidably mounted to main shell 2 to allow the position of the member to be adjusted to a particular wearer's head. Several concepts to allow sliding movement and releasably locking in position are illustrated in FIGS. 9 through 14.

Figure 9B:
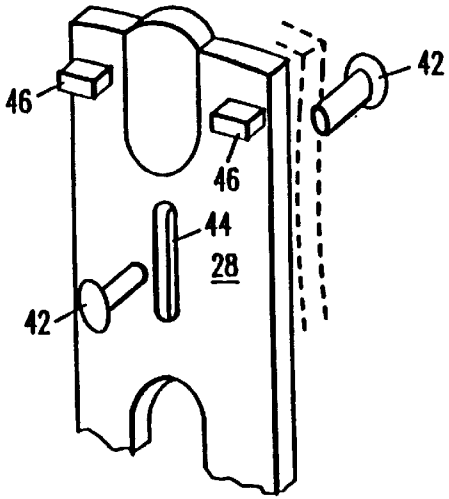
FIGS. 9*a* and 9*b* are perspective views showing a sliding adjustment and locking feature for the articulated member of an alternative embodiment.
Figure 9A:
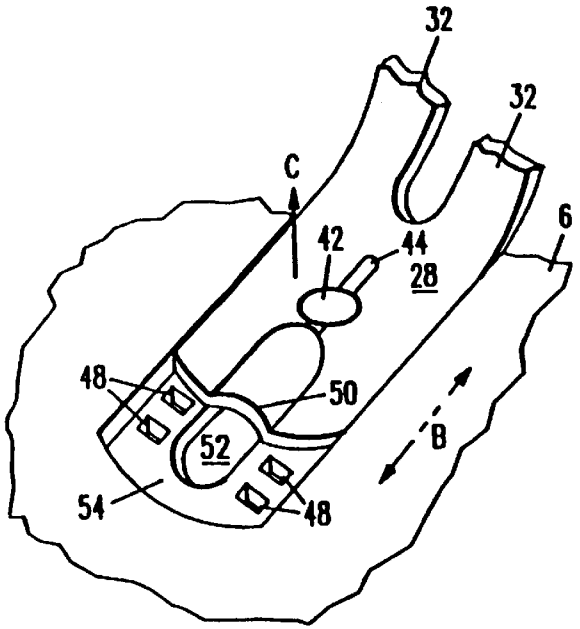

FIGS. 9*a* and 9*b* show on alternative embodiment for adjusting the position of the articulated member 14. Proximal end 28 is slidably attached to the interior surface 6 with a suitable fastener 42, such as a rivet, screw or split, plastic, flanged post. Fastener 42 passes through longitudinal slot 44 in the proximal end 28, thereby retaining the articulated member 14 on the main shell 2 while allowing it to slide in the longitudinal direction shown by arrow B.

A pair of tabs 46 protrude from proximal end 28 and each tab 46 engages a notch 48 to prevent the proximal end 28 from sliding. Two rows of notches 48 are provided, spaced laterally apart to accommodate the spacing of the two tabs. The notches 48 are spaced longitudinally, to provide alternative locking positions as the proximal end 28 is adjusted by sliding longitudinally. To allow the proximal end 28 to slide, the wearer is able to flex the proximal end 28 away from the main shell 2 in the direction of arrow C to momentarily disengage tabs 46 from notches 48. Once the proximal end 28 is slid in the direction of arrow B to a new position and released, the resilient force of the flexed proximal end 28 allows tabs 46 to engage with a new pair of notches 48.

Projection 50 in the proximal end 28 and hollow 52 in the interior surface 6 facilitate the wearer's ability to grasp the proximal end 28 for easy adjustment. The proximal end 28 can be located in a recess 54 in the interior surface 6 to provide greater comfort to the wearer and to longitudinally guide the proximal end 28 during adjustment.

Figure 10:
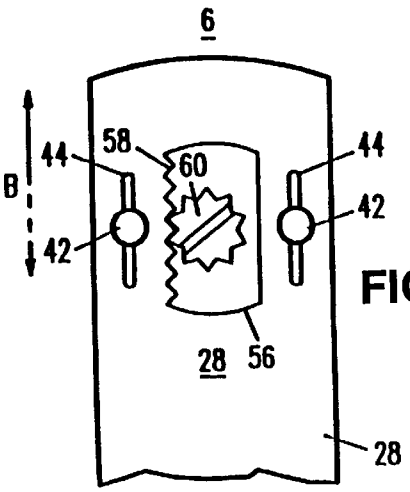
FIG. 10 is a perspective view showing a sliding adjustment and locking feature for the articulated member of an alternative embodiment.

FIG. 10 shows another alternative embodiment for adjusting the position of the articulated member 14. Proximal end 28 is slidably attached to the interior surface 6 with a pair of suitable fasteners 42, such as rivets, screw or split, plastic, flanged posts. Fasteners 42 passes through longitudinal slots 44 in the proximal end 28, thereby retaining the articulated member 14 on the main shell 2 while allowing it to slide in the longitudinal direction shown by arrow B.

A cutout 56 is provided in the proximal end 28 with a rack of teeth 58 located along an edge of cutout 56, having teeth spaced in a longitudinal direction. A pinion 60 is rotatably mounted to the interior surface 6 within the cutout 56 such that it engages the rack of teeth 58. Pinion 60 can be rotated with a screwdriver, coin or the like to drive the proximal end 28 in a longitudinal direction.

Once adjusted, the proximal end 28 can be held in place by friction between the pinion 60 and interior surface 6 and/or friction between proximal end 28 and interior surface 6. Alternatively, the proximal end 28 can be locked down by tightening screw fasteners 42 after adjustment.

Figure 11:
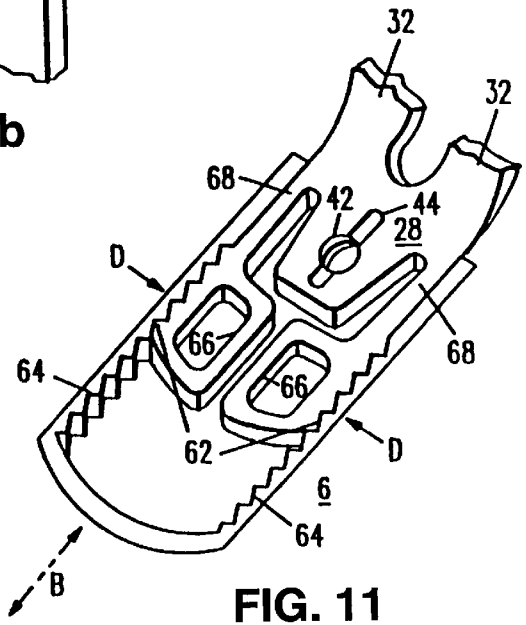
FIG. 11 is a perspective view showing a sliding adjustment and locking feature for the articulated member of an alternative embodiment.

FIG. 11 shows yet another alternative embodiment for adjusting the position of the articulated member 14. Proximal end 28 is slidably attached to the interior surface 6 with a suitable fastener 42, such as a rivet, screw or split, plastic, flanged post. Fastener 42 passes through longitudinal slot 44 in the proximal end 28, thereby retaining the articulated member 14 on the main shell 2 while allowing it to slide in the longitudinal direction shown by arrow B.

Opposite sides of proximal end 28 are fitted with teeth 62 spaced in a longitudinal direction. Each of the two sets of teeth 62 engages a complementary rack of teeth 64 attached to the interior surface 6 of the main shell 2 to releasably prevent the proximal end 28 from moving. A pair of finger holes 66 and a pair of flexures 68 are both incorporated into the opposite sides of proximal end 28 for allowing the wearer to flex the two sets of teeth 62 inwardly towards each, as shown by arrows D, and out of engagement with the racks of teeth 64. In this manner, the wearer can slide the proximal end 28 longitudinally, as shown by arrow B. When inward pressure is released from the finger holes 66, flexures 68 urge teeth 62 outwardly back into engagement with racks of teeth 64, thereby locking the articulated member 14 into position after adjustment.

FIGS. 12*a* and 12*b* show yet another alternative embodiment for adjusting the position of the articulated member 14. Proximal end 28 is slidably attached to the interior surface 6 with a suitable fastener 42, such as a rivet, screw or split, plastic, flanged post. Fastener 42 passes through longitudinal slot 44 in the proximal end 28, thereby retaining the articulated member 14 on the main shell 2 while allowing it to slide in the longitudinal direction shown by arrow B.

A cutout 70 is provided through proximal end 28, having opposite sides formed by two racks of teeth 72, the teeth being spaced in a longitudinal direction. A complementary shaped, raised portion 74 is provided on the interior surface 6, partially filling cutout 70. Raised portion 74 is provided with teeth 76 on opposite sides for engagement with the two racks of teeth 72.

The raised portion has a longitudinal length that is shorter than that of cutout 70, so that the proximal end 28 may be alternatively adjusted and locked into a plurality of positions with respect to the main shell 2. To make such an adjustment, the wearer grasps the proximal end 28 at projection 50 and resiliently flexes the proximal end 28 away from interior surface 6, as shown by arrow C in FIG. 12*b*. This disengages the two racks of teeth 72 from teeth 76 and allows the wearer to move the proximal end 28 longitudinally, as shown by arrow B. When the projection 50 on the proximal end 28 is released after adjustment, a different portion of the two racks of teeth 72 are resiliently urged into engagement with teeth 76 on raised portion 74.

The proximal end 28 can be located in a recess 54 in the interior surface 6, as shown in FIG. 12*b*, to provide greater comfort to the wearer and to longitudinally guide the proximal end 28 during adjustment. Also, raised portion 74 and fastener 42 can be formed on a single plate 78 which is recessed when mounted on interior surface 6, as shown in FIG. 12*a* (or further recessed if used in conjunction with recess 54 in FIG. 12*b*).

Figure 13A:
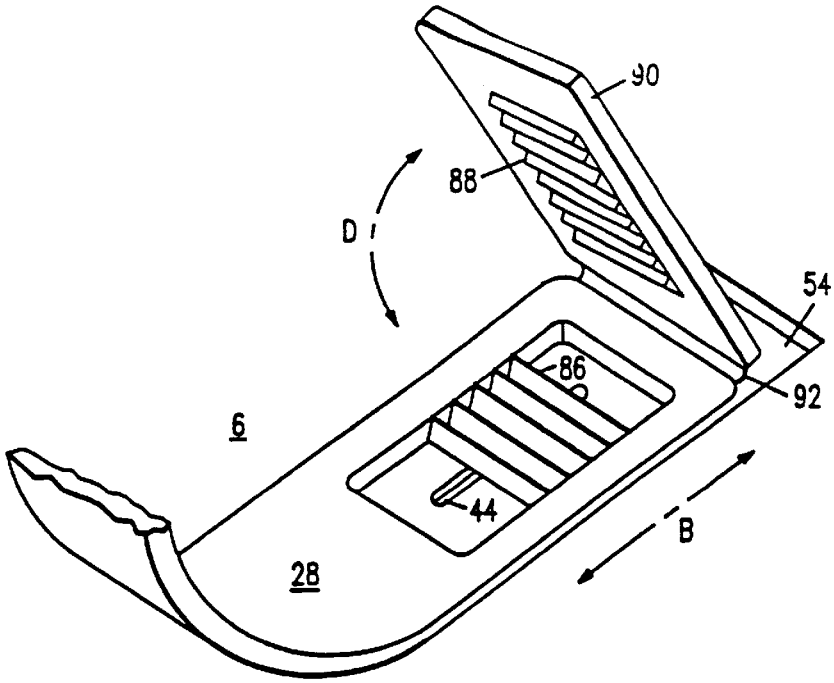
FIGS. 13*a* and 13*b* are perspective views showing a sliding adjustment and locking feature for the articulated member of an alternative embodiment.
Figure 13B:
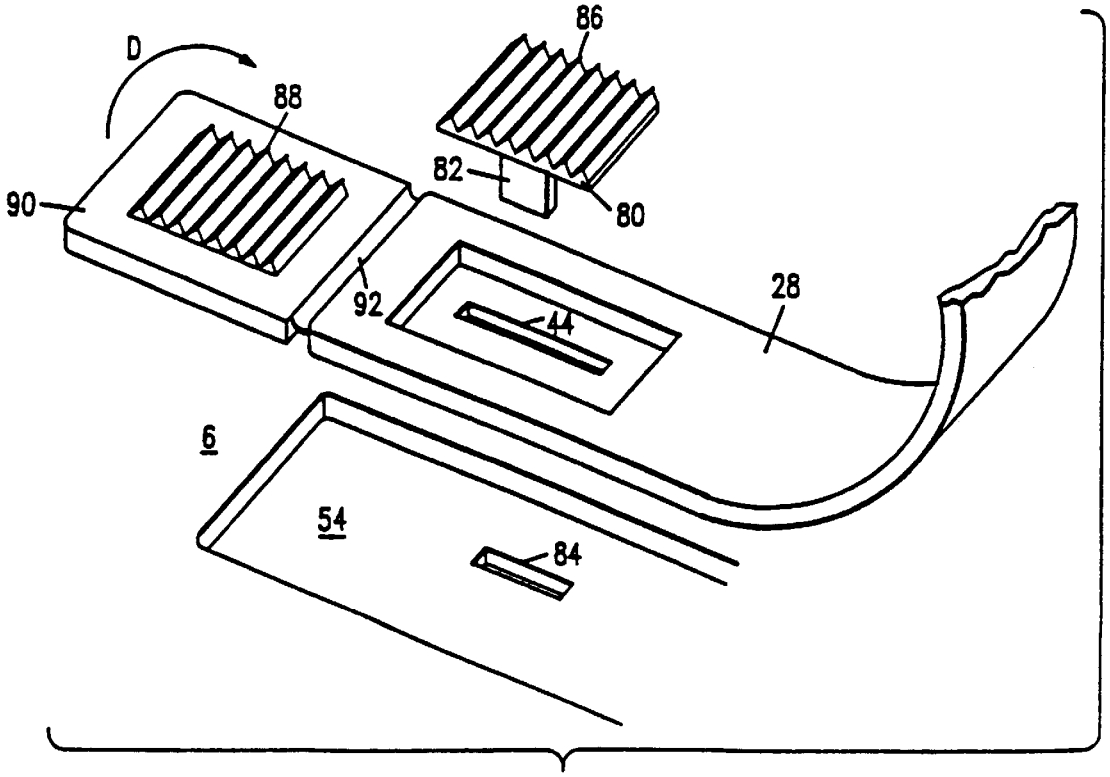

FIGS. 13*a* and 13*b* show yet another alternative embodiment for adjusting the position of the articulated member 14. Proximal end 28 is slidably attached to the interior surface 6 with a plate 80 and post 82 arrangement. Post 82 depends from plate 80 and passes through longitudinal slot 44 in the proximal end 28, and is received in slit 84 to attach the plate 80 to the interior surface 6, thereby retaining the articulated member 14 on the main shell 2 while allowing it to slide in the longitudinal direction shown by arrow B.

A plurality of ridges 86 are formed on plate 80 opposite post 82. A complementary set of ridges 88 is formed in flap 90, which is hingedly connected to proximal end 28 by a "living hinge" 92. Flap 90 may be folded back over onto proximal end 28, as shown by arrow D, and snapped into place, thereby engaging ridges 86 with ridges 88 and preventing proximal end 28 from movement. Adjustment is accomplished by unsnapping flap 90 to disengage ridges 88 from ridges 86, longitudinally sliding proximal end 28 to a new position, and snapping flap 90 back into position so that ridges 88 re-engage ridges 86.

Figure 14A:
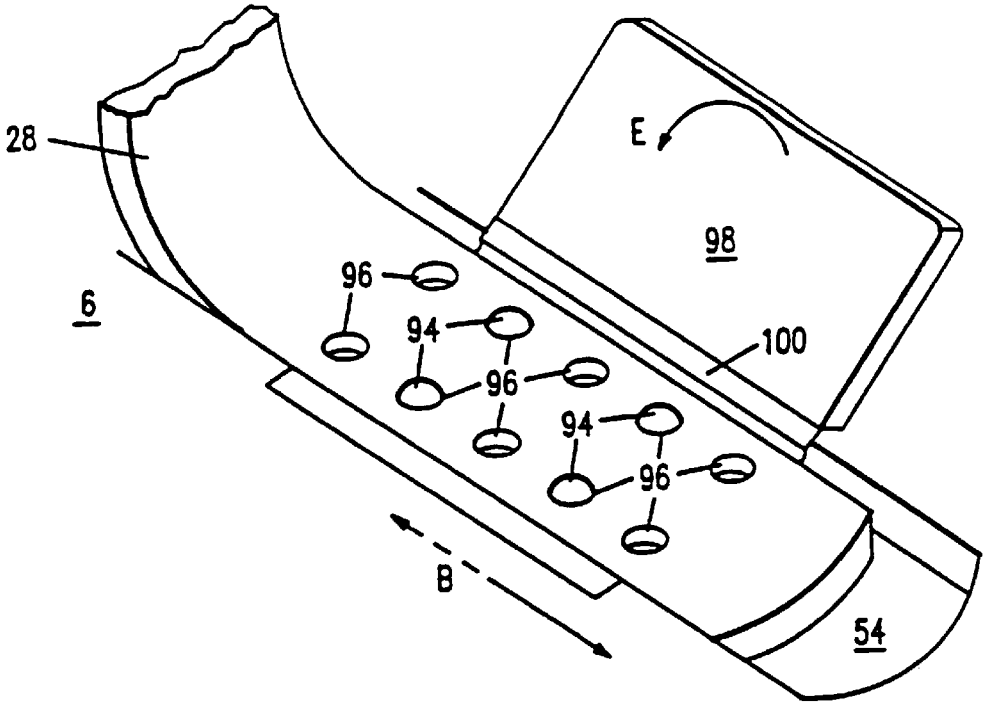
FIGS. 14*a* and 14*b* are perspective views showing a sliding adjustment and locking feature for the articulated member of an alternative embodiment.

FIG. 14*a* shows yet another alternative embodiment for adjusting the position of the articulated member 14. Two pairs of laterally spaced posts 94 are spaced longitudinally apart on interior surface 6. A plurality of pairs of mating holes 96 are longitudinally spaced along the proximal end 28 and two pairs of holes 96 at one time receive the two pairs of posts 94 to prevent the proximal end from moving longitudinally. Flap 98 is hingedly connected to interior surface 6 by living hinge 100, and snaps over proximal end 28 to secure it on posts 94, as shown by arrow E. Adjustment is accomplished in a fashion similar to that described above for previous embodiments.

Figure 14B:
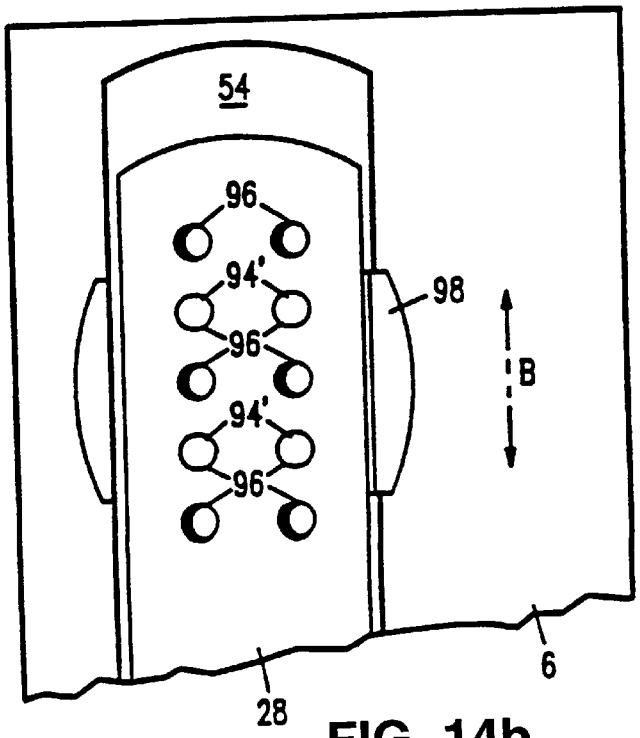

FIG. 14*b* shows one more alternative embodiment for adjusting the position of the articulated member 14. This embodiment is similar to that of FIG. 14*a*, but does not have a hingedly connected flap. Proximal end 28 is retained by posts 94', which have larger diameters at their distal ends than at their bases or than the diameters of the holes 96, thereby retaining proximal end 28 between the distal ends of posts 94 and the interior surface 6. This allows proximal end 28 of articulated member 14 to be unsnapped from posts 94', adjusted longitudinally, and snapped back onto the posts 94' with a different set of holes 96. Posts 94' can be formed on a plate 98, which is attached to main shell 2.

Figure 16:
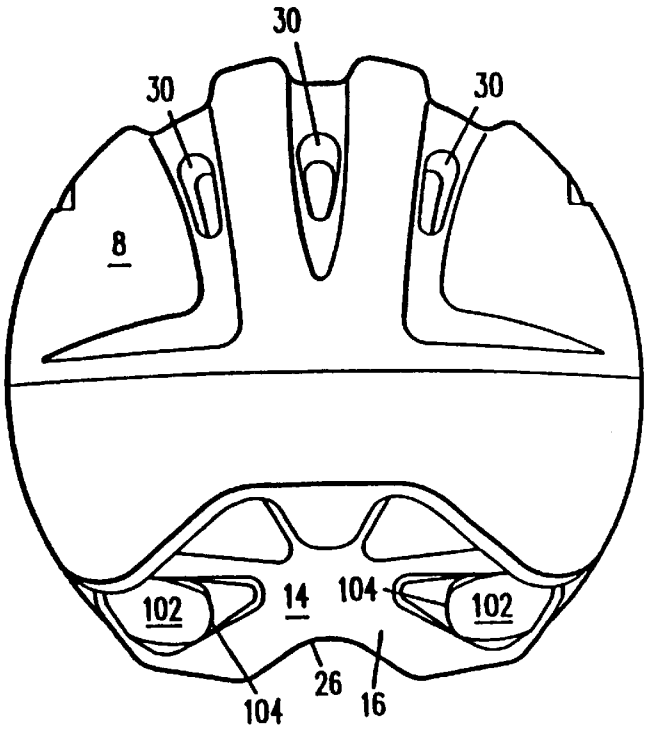
FIG. 16 is a rear elevation view showing the preferred embodiment of the inventive helmet.
Figure 15:
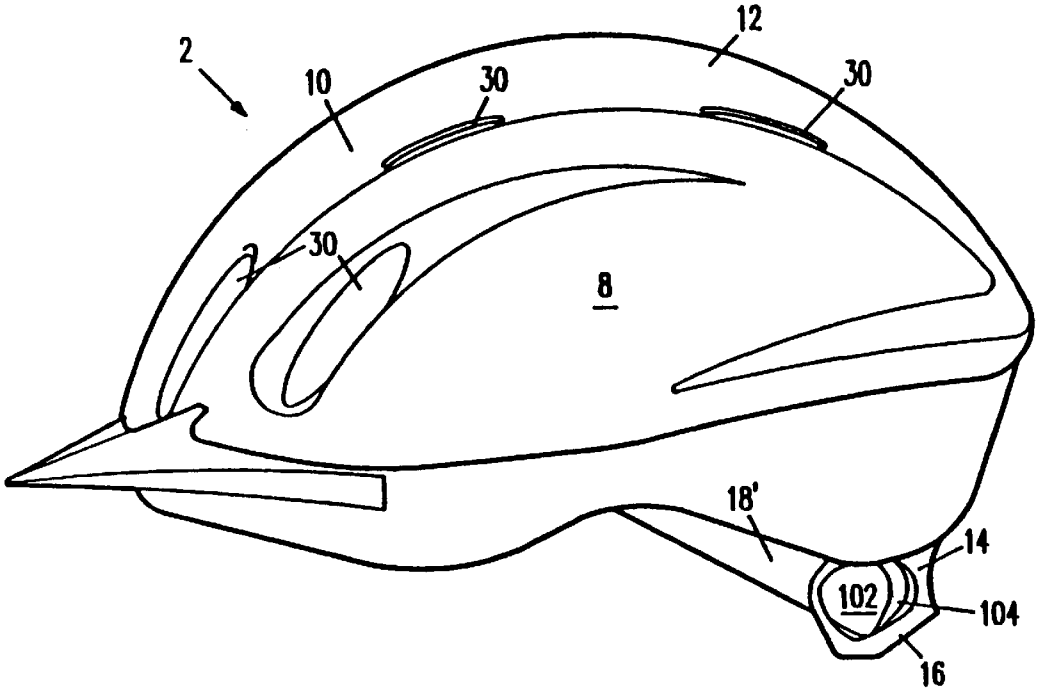
FIG. 15 is a side elevation view showing the preferred embodiment of the inventive helmet.
Figure 17B:
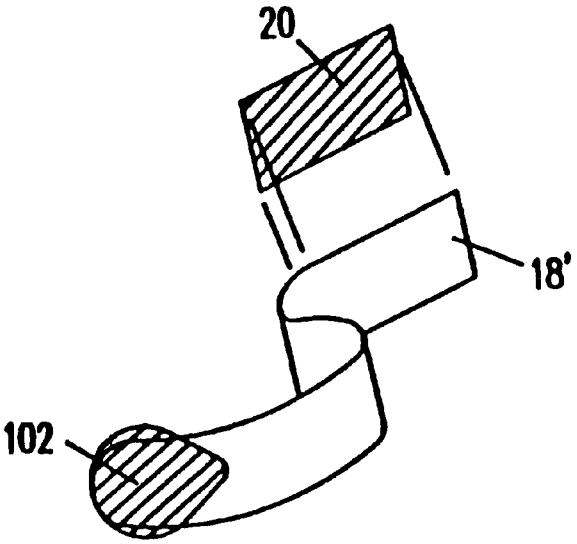
FIG. 17 is a rear elevation view showing the preferred embodiment of the articulated member.
Figure 17A:
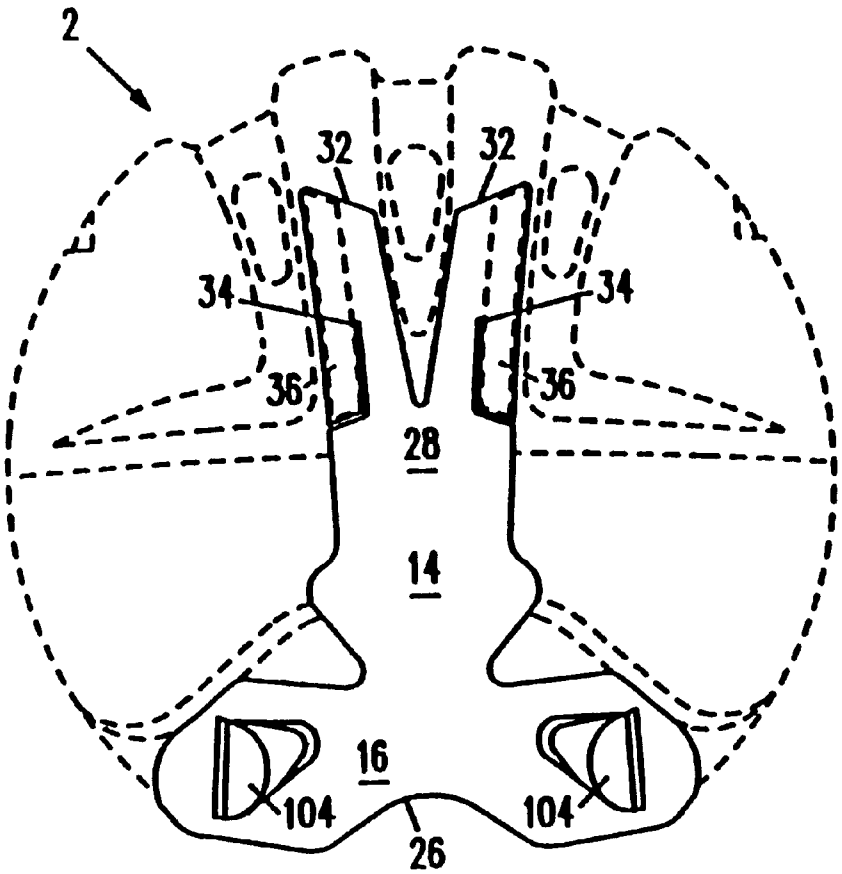

The general and alternate embodiments described above and shown in FIGS. 1 through 14 illustrate the general concept of the present invention. The preferred embodiment, as shown in FIGS. 15 through 17, is the intended design as it is envisioned for production, and operates substantially in an identical manner.

In the preferred embodiment, two straps 18' are used to connect the articulated member 14 to the main shell 2. Each strap 18' is connected to the articulated member 14 with a strap connector 102. Strap connectors 102 are plastic tabs that are ultrasonically welded onto one end of elastic straps 18', and fit into and are retained by pockets 104 in the articulated member 14. The opposite ends of straps 18' are adjustably attached to patches 20 of VELCRO® hook and loop type fasteners glued inside the main shell 2. In the preferred embodiment, all of the force exerted by the articulated member 14 against the wearer's head is generated by the stretching of straps 18'. In the relaxed position when not being worn and with the straps 18' removed, the articulated member 14 rests against the inside of the rear of the helmet.

In another alternative embodiment shown in FIGS. 18*a* through 20, the articulated member 14 may be attached to the inside of the main shell 2 with a snap-in arrangement. This arrangement reduces manufacturing costs by eliminating the need for adhesive tape and requires very little labor to snap the articulated member 14 in place.

Figures 18A, 18B:
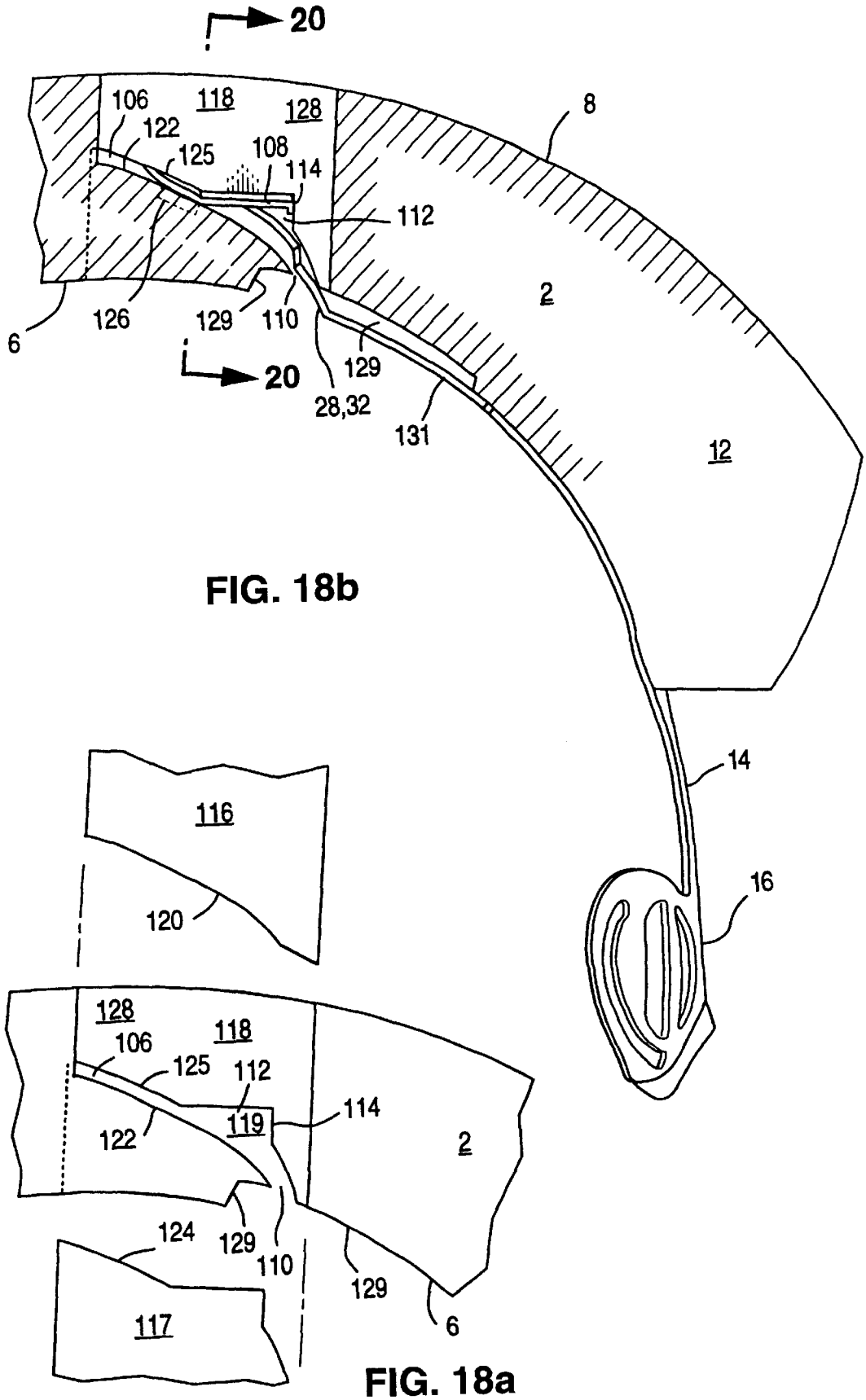
FIG. 18*a* is a side elevational cross-section view showing the articulated member in the arcuate passage.
FIG. 18*b* is a fragmentary side elevational view showing the arcuate passage and the dies used to make it.
Figure 18D:
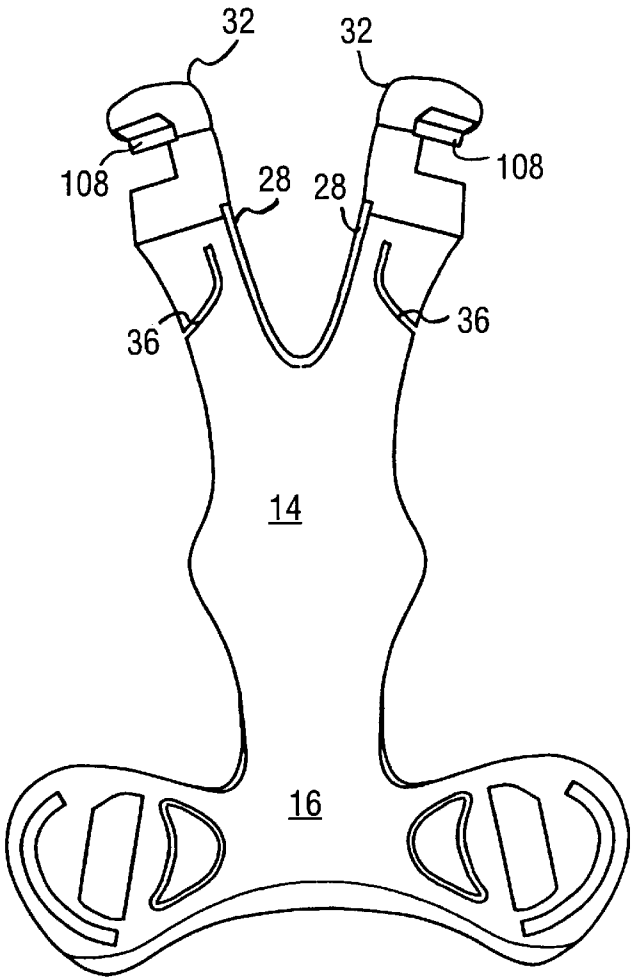
Figure 18C:
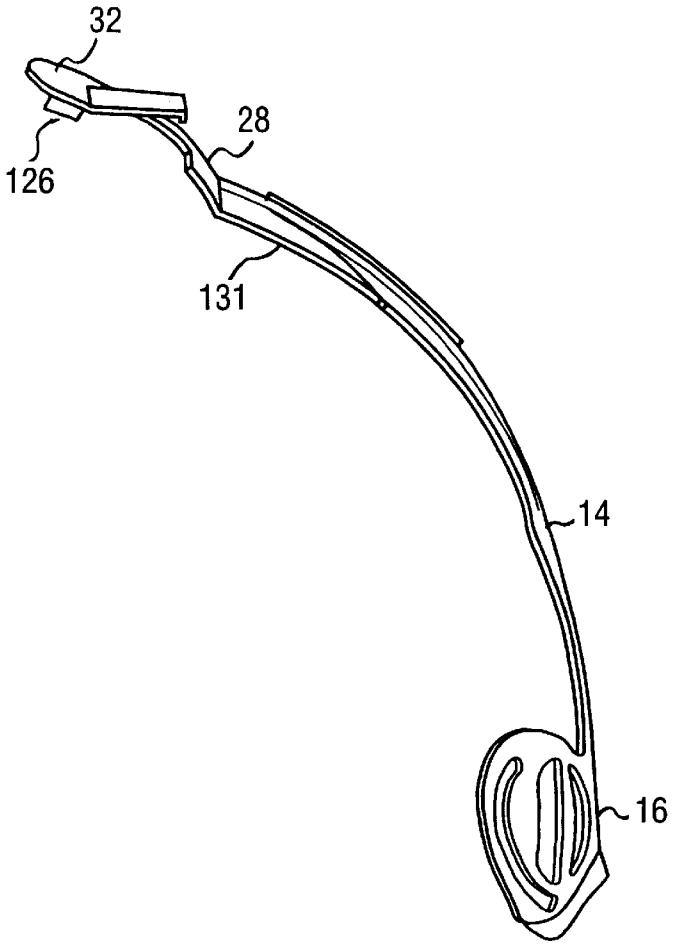

Referring to FIG. 18*b*, an arcuate passage 106 is shown in the main shell 2. A single arcuate passage 106 can be used if the proximal end 28 of the articulated member 14 has only one end. However, when the proximal end 28 has two tines 32, as shown in FIG. 18*d*, two arcuate passages 106 are used, with the passages being identical mirror images of each other. For clarity, only one passage 106 and one tine 32 are shown in FIGS. 18*a*, 18*b*, 18*c*, 19 and 20. Preferably, passage 106 is located toward the forward portion of the rear half 12 of main shell 2, and curves upward towards the front half 10. Passage 106 communicates with the interior of the helmet through slit 110.

A resiliently flexible barb 108 is formed on each tine 32. Barb 108 resiliently flattens down when the proximal end 28 of the articulated member 14 is inserted into arcuate passage 106 through slit 110. Barb 108 springs back to its original rearward and upward protruding direction when it encounters pocket 112, which is above and communicates with the arcuate passage 106. Barb 108 abuts the rear surface 114 of pocket 112 to permanently retain the proximal end 28 in the main shell 2. An access hole (not shown) connecting the pocket 112 with the exterior surface 8 could be added if it were desired to make the articulated member 14 removable by pressing barb 108 down.

Figure 19:
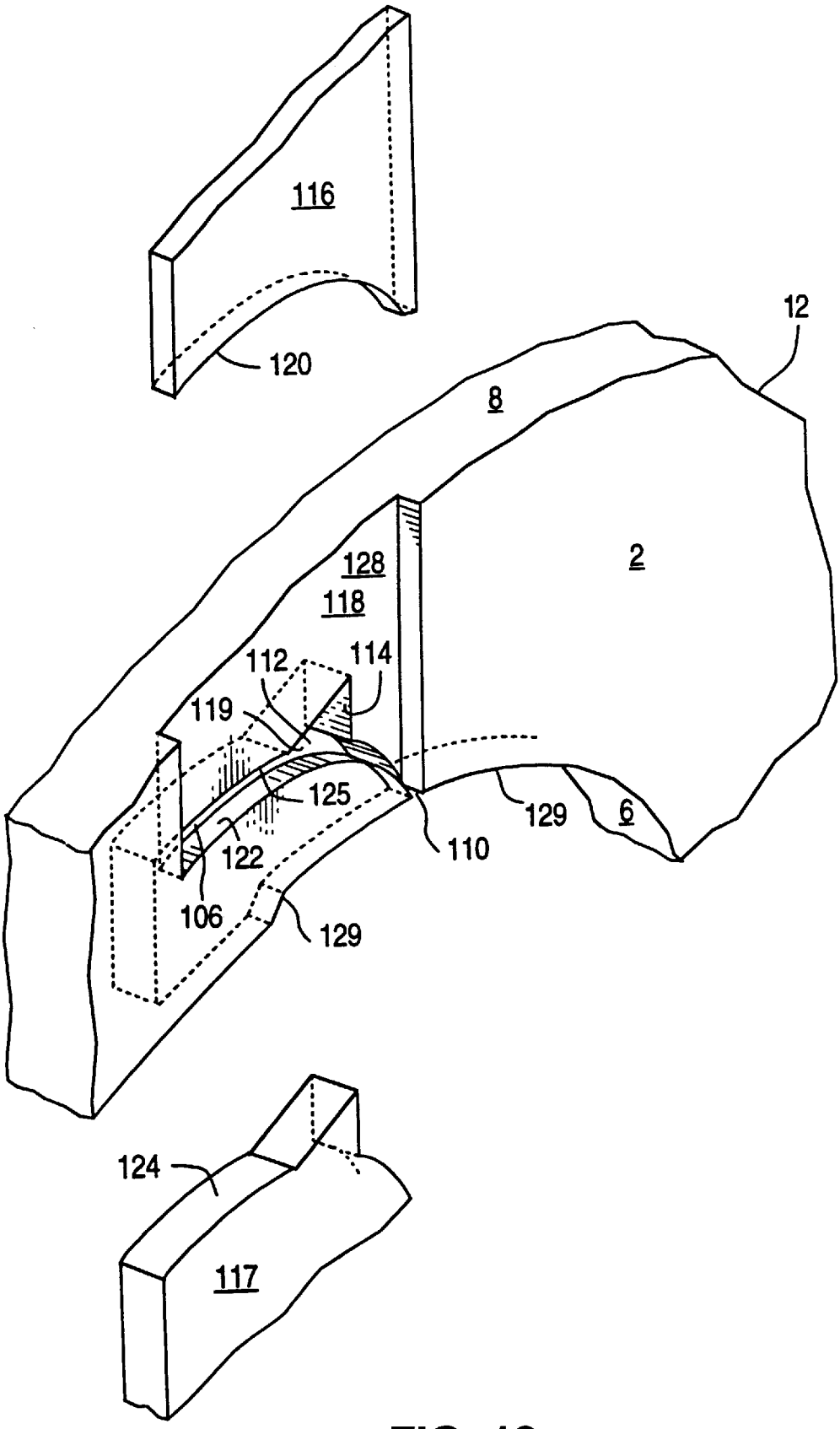
FIG. 19 is a fragmentary perspective view of FIG. 18.
Figure 20:
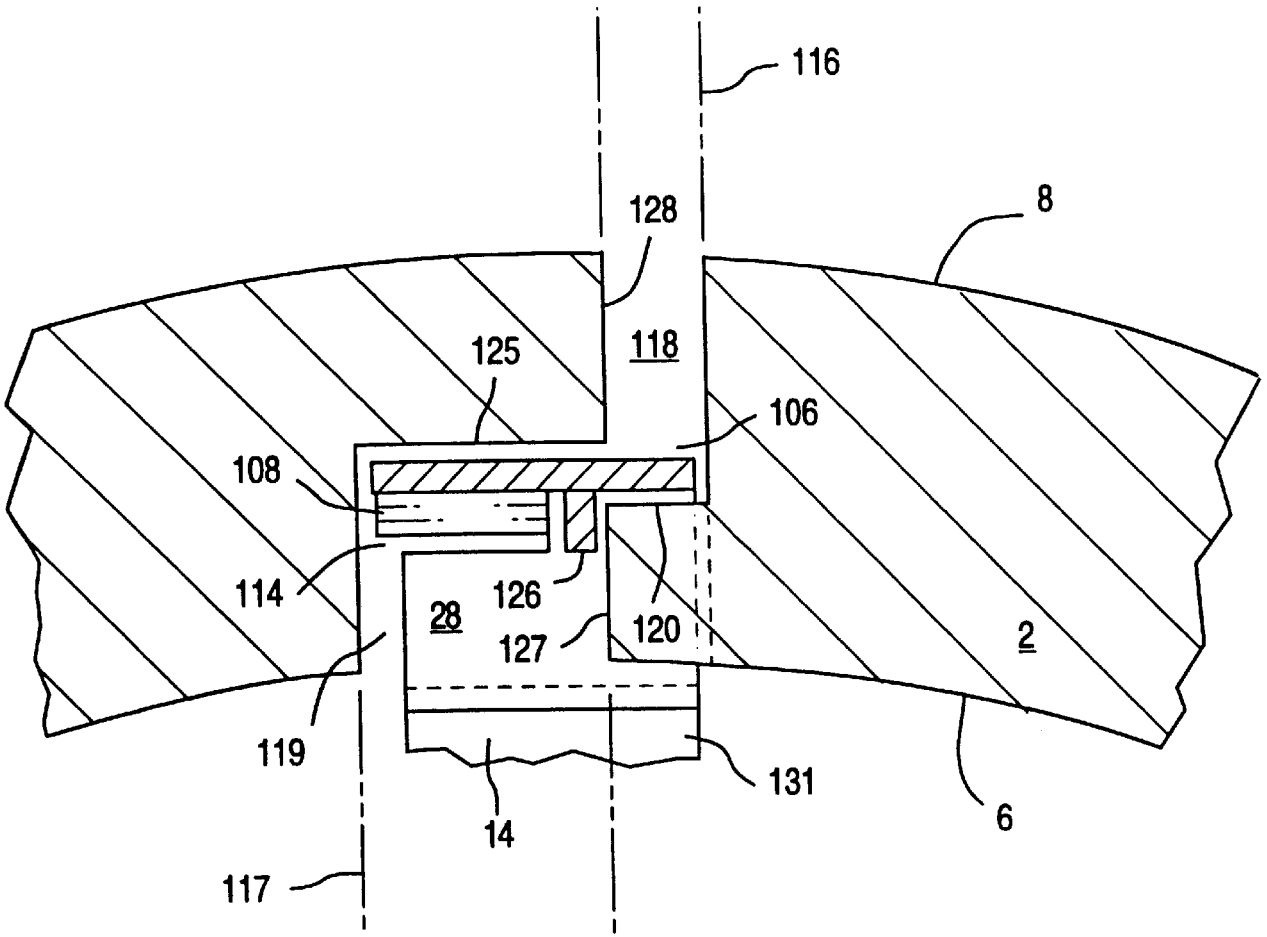
FIG. 20 is a front elevational cross-section view taken along line 20—20 in is FIG. 18*b*, showing the articulated member in the arcuate passage.

Referring to FIGS. 18*a* and 19 and 20, main shell 2 is typically formed by a molding process, with a lower mold half (not shown) forming the interior surface 6 of the helmet, and a separable upper mold half (not shown) forming the exterior surface 8. Because of this molding process, the arcuate passage 106 cannot be directly formed if main shell 2 is to be fabricated in a single molded piece. To get around these molding constraints, arcuate passage 106 can be formed by utilizing an upper die 116 attached to the upper mold half, and a lower die 117 attached to the lower mold half. The upper die 116 creates an upper void 118 during the molding process, while lower die 117 creates a lower void 119. The upper die 116 and lower die 117 are offset so that when the two mold halves come together, the upper die 116 and the lower die 117 are side by side and overlap slightly. The region of die overlap forms the arcuate passage 106 and is greater than the thickness of the proximal end 28 so as to accommodate it. The total width of the upper die 116 and the lower die 117 when side by side is greater than the width of the proximal end 28. The bottom 120 of upper die 116 forms an arcuate surface 122 which partially defines the bottom of the arcuate passage 106, and also forms part of slit 110 through the interior surface 6. The top 124 of lower die 117 forms a complementary arcuate surface 125 which partially defines the top of arcuate passage 106, and also forms pocket 112.

Referring to FIGS. 18*b* and 20, a downward protruding tab 126 can be formed on the proximal end 28 to help stabilize the articulated member 14 from lateral movement. Tab 126 contacts the inside surface 127 of the lower void 119 to prevent the proximal end from moving to the right. For added safety from possible contact with the top of the wearer's head, tab 126 can alternatively protrude upwardly (not shown) to contact the inside surface 128 of upper void 118, or the tab can be partially punched from a cutout in the proximal end 28 (not shown) so as to be able to be flexed back into the cutout during a severe impact. For added stability, tabs can protrude both upwardly and downward (not shown).

Referring to FIGS. 18*a*, 18*b* and 19, a recess 129 is preferably formed on the interior surface 6 of the main shell 2 behind slit 110 to accommodate the articulated member 14 so that it is flush with the interior surface 6. This allows a substantially continuous arc to be formed by the bottom surface 131 of the articulated member 14 and the interior surface 6 forward of the slit 110, thereby providing greater comfort for the wearer.

Figure 21:
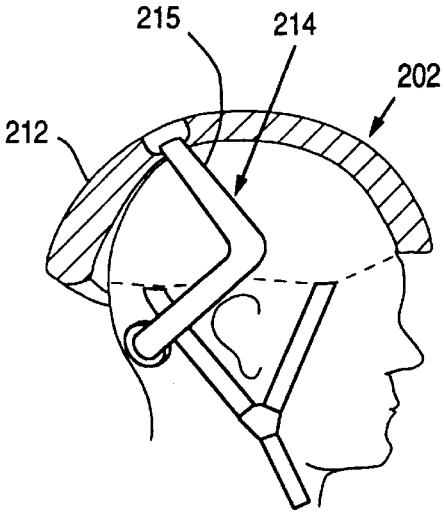
FIG. 21 is a side elevational view, partially in section, similar to FIG. 1 but showing another alternative embodiment of the present invention.
Figure 22:
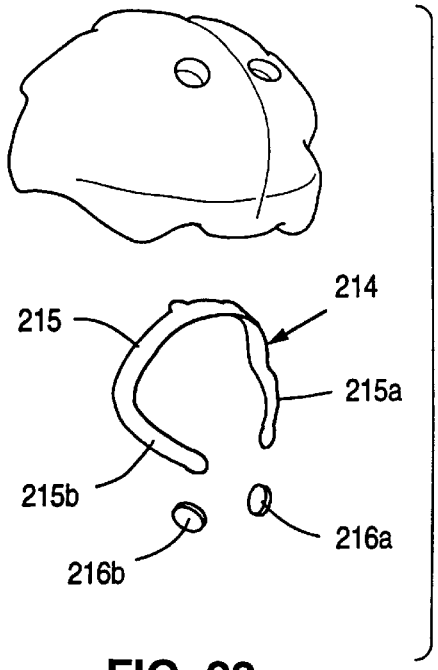
FIG. 22 is an exploded rear perspective view similar to FIG. 5 but showing the embodiment of FIG. 21.

Referring now to FIGS. 21 and 22, there is shown an alternative embodiment of the present invention wherein the articulated member 214 has a laterally arched central portion 215 which is joined at its midpoint to the rear half 112 of the helmet main shell 202. At the ends of the arched central portion 215 are a pair of flex-arm extensions 215*a* and 215*b* which have cushion pads 216*a* and 216*b* at their distal ends for engaging the inwardly curved portion of the posterior of the head of the wearer. The articulated member 214 including both its laterally arched central portion 215 and its flexure extensions 215*a* and 215*b* can resiliently flex away from the head of a wearer when the wearer places the helmet on his/her head, and once the helmet is placed on the wearer's head, these members provide the resilient pressure against the inwardly curved portion of the posterior of the wearer's head. As in certain other embodiments the connection of the laterally arched central portion to 15 of the articulated member is forward of the back of the neck of the wearer. In these figures, the chin strap is shown in its ultimate position when the helmet is in place, and the chin strap is not attached to the articulated member.

Figure 23:
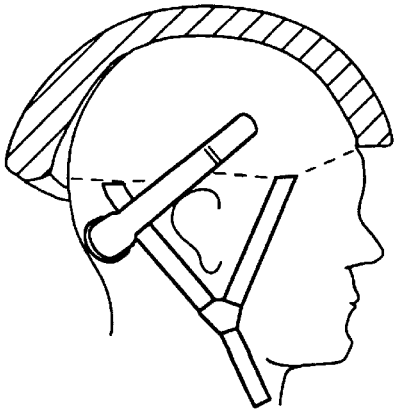
FIGS. 23 and 24 are views similar to FIGS. 21 and 22, but illustrating still another embodiment of the present invention.
Figure 24:
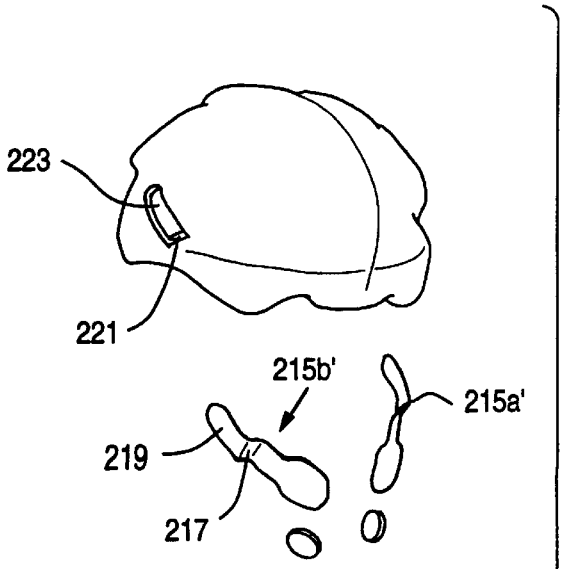

Referring now to FIGS. 23 and 24, there is shown still another alternative embodiment of the present invention similar to the embodiment shown in FIGS. 21 and 22 except that the flex arm extensions 215*a*' and 215*b*' are attached directly to the sides of the helmet such as by having a bent section 217 which fits through a slot opening 221 in the helmet so that the end 219 is captured recess 223. The flex arms 215*a*' and 215*b*' provide similar flexure against the inwardly curved portion on the posterior of the head of the wearer, except that the mounting point of the proximal ends of the flex arms 215*a*' and 215*b*' are at the sides of the helmet at the slot opening 217 and recess 223 rather than at the top of the helmet.

Figure 25A:
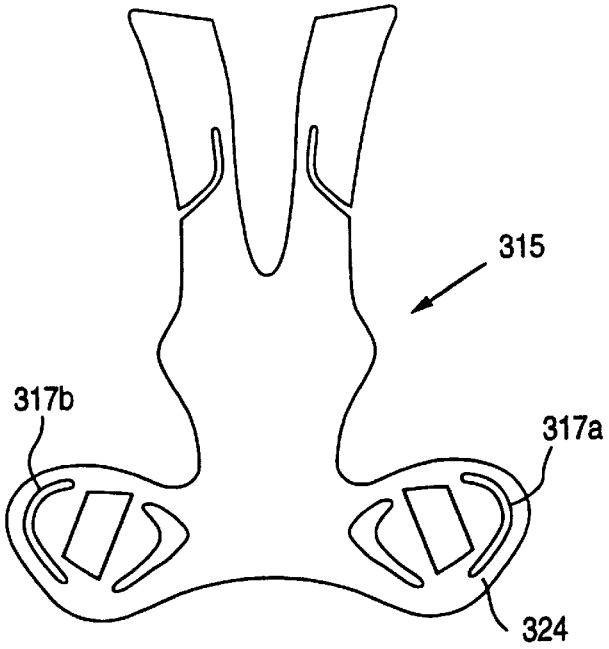
FIGS. 25(*a*) and 25(*b*) are plan views of the articulated member and padding strap of still another embodiment of the present invention.
Figure 26:
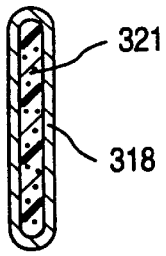
FIG. 26 is a cross-sectional view of a portion of the structure shown in FIG. 25(*b*) taken along the line F—F in the direction of the arrows.
Figure 27:
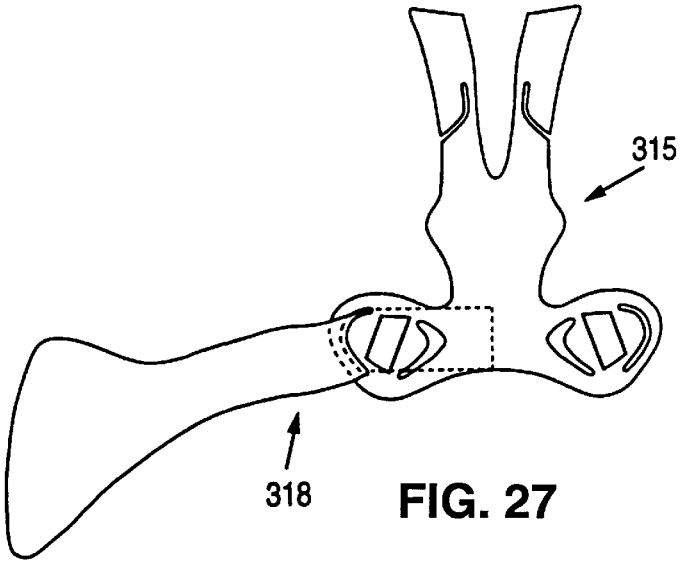
FIG. 27 is a plan view of the articulated member of FIG. 25(*a*) and one-half of the padded strap of FIG. 25(*b*) assembled for insertion into a helmet.
Figure 25B:
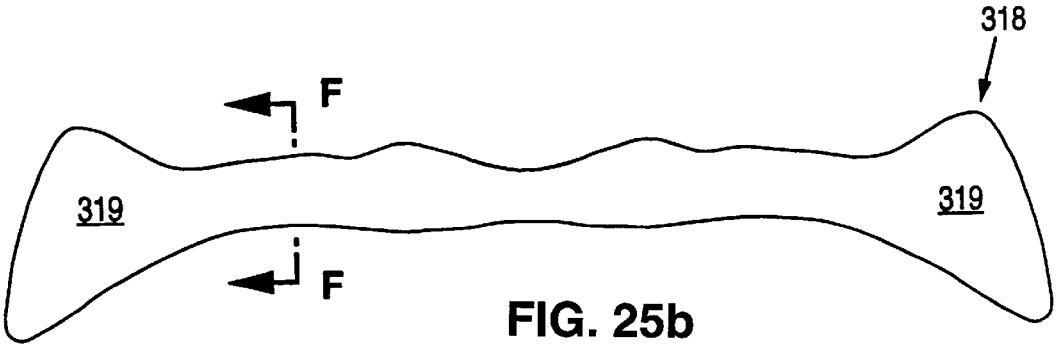

Referring now to FIGS. 25, 26 and 27 there is disclosed still another alternative embodiment of the present invention wherein the attachment strap is padded and provides the padding between the helmet shell and the head of the wearer. The articulated member 315 is similar to the articulated member 14 illustrated in FIGS. 15–17 but with the additional provision of arcuate slots 317*a* and 317*b* near the outer ends of the outer binds 324 on the "T" at the distal end of the articulated member 315. An elongated wraparound padded strap 318 is slidably passed through the slots 317*a* and 317*b* so that the forward ends 219 thereof wrap around the side of the head of the wearer between the head of the wearer and the lower sides of the helmet shell for attachment to the helmet shell. In the preferred version of this embodiment and as shown in FIG. 26, the strap 318 is made with a brushed nylon outside surface that operates as a loop fastener material of the hook and loop type fastener type and surrounds foam padding 321 such as polyester foam of 1.5 pound density. The helmet includes patches of loop type fastening material such as the Velcro c hook type material 20 as shown in FIG. 17*b* and which is attached to the helmet shell along the interior sides. Thus, this strap 318 which has some elasticity helps provide the pressure for the articulated member 315 against the wearer's head and can be adjusted in length by positioning the ends 319 at different locations with respect to the hook-type fasten material within the helmet and at the same time provide the necessary padding between the wearer's head and the helmet shell itself.

It is to be understood that the present invention is not limited to the sole embodiments described above and illustrated herein, but encompasses any and all variations falling within the scope of the appended claims.

What is claimed:

1. A bicycle helmet comprising:

a shell assembly substantially covering a top portion of a wearer's head only above the ears of the wearer and having a front, a back, opposite sides and a bottom edge, at least one articulated member depending from the shell assembly and having a proximal end and a distal end, the proximal end secured to the inside of the back of said shell assembly, above said bottom edge of said shell assembly, the articulated member having a length that extends downwardly beyond the bottom rear edge of the helmet to position said distal end to continuously engage the back of the head of the wearer and free from direct engagement with any portion of said shell assembly other than where said proximal end is secured to said shell assembly, said articulated member being resiently flexible for allowing the distal end of the articulated member to resiliently flex rearward when the helmet is donned and to provide a continuous resilient forward pressure against an inwardly curved portion on the posterior of a wearer's head when the helmet is in place on the head of the wearer, thereby providing a more securely fitted helmet; and a flexible connection between the articulated member and the opposite sides of the shell assembly including at least one elastically elongatable strap portion for providing additional resilient forward pressure against an inwardly curved portion on the posterior of a wearer's head.

2. A support device for retaining a bicycle helmet on the head of a wearer said helmet having a shell assembly with a front and a back substantially covering a top portion of the head of a wearer with the bottom edge of the helmet above the ears of the wearer comprising:

an arcuate arm for mounting on the inside of said back of the helmet and having a length and curved shape that extends downwardly beyond the bottom edge of the helmet for engaging the back of the head of a wearer below the widest region of the head of a wearer, said arm being resiliently flexible to provide a continuous resilient forward pressure against an inwardly curved portion on the posterior of a wearer's head, the arcuate arm having a length that extends downwardly beyond the bottom rear edge of the helmet to position the distal end of said arm to continuously engage the back of the head of the wearer below the widest region of the head of the wearer and free from engagement with any portion of said shell assembly other than where that proximal end of said arm is secured to said shell assembly.

3. A bicycle helmet comprising:

a shell assembly substantially covering a top portion of a wearer's head and having a front, a back and opposite sides;

at least one articulated member depending from the shell assembly and having a proximal end and a distal end, the proximal end secured to the inside of the back of said shell assembly;

said articulated member being resiliently flexible for allowing the distal end of the articulated member to resiliently flex rearward when the helmet is donned to provide a resilient forward pressure against an inwardly curved portion on the posterior of a wearer's head, thereby providing a more securely fitted helmet;

a flexible connection between the articulated member and the opposite sides of the shell assembly including at least one elastically elongatable strap portion for providing additional resilient forward pressure against an inwardly curved portion on the posterior of a wearer's head; and means for adjustably attaching the proximal end of said articulated member relative to the shell assembly.

4. A bicycle helmet comprising:

a shell assembly substantially covering a top portion of a wearer's head only above the ears of the wearer and having a front, a back, opposite sides and a bottom edge;

at least one articulated member depending from the shell assembly and having a proximal end and a distal end, the proximal end secured to the inside of the back of said shell assembly above said bottom edge of said shell assembly, said articulated member having a length that extends downwardly beyond the bottom rear edge of the helmet to position said distal end to continuously engage the back of the head of the wearer below the widest region of the head of the wearer;

said articulated member being resiliently flexible for allowing the distal end of the articulated member to resiliently flex rearward when the helmet is donned to provide a continuous resilient forward pressure against an inwardly curved portion on the posterior of a wearer's head, thereby providing a more securely fitted helmet when the helmet is in place on the head of the wearer; and a flexible connection between the articulated member and the opposite sides of the shell assembly including at least one elastically elongatable strap portion for providing additional resilient forward pressure against an inwardly curved portion on the posterior of a wearer's head and a hook and loop type fastener forming an adjustable connection.

5. A bicycle helmet comprising:

a shell assembly substantially covering a top portion of a wearer's head and having a front, a back and opposite sides;

at least one articulated member depending from the shell assembly and having a proximal end and a distal end, the proximal end secured to the inside of the back of said shell assembly;

said articulated member being resiliently flexible for allowing the distal end of the articulated member to resiliently flex rearward when the helmet is donned to provide a resilient forward pressure against an inwardly curved portion on the posterior of a wearer's head, thereby providing a more securely fitted helmet; and a flexible connection between the articulated member and the opposite sides of the shell assembly including at least one elastically elongatable strap portion for providing additional resilient forward pressure against an inwardly curved portion on the posterior of a wearer's head and said articulated member being T-shaped with the top of the "T" inwardly curved in a lateral direction to extend around the posterior of a wearer's head.

6. A support device for retaining a bicycle helmet on the head of a wearer said helmet having a shell assembly with a front and a back substantially covering a top portion of the head of a wearer comprising:

an arcuate arm for mounting on said back of the helmet so that the arm extends downwardly beyond the bottom rear edge of the helmet for engaging the back of the head of a wearer below the widest region of the head of a wearer, said arm being resiliently flexible to provide a resilient forward pressure against an inwardly curved portion on the posterior of a wearer's head;

a flexible connection including an elastic strap for connecting the lower end of said arm to opposite sides of a helmet; and means for adjustably attaching the end of said arcuate arm mounted on the back of the helmet relative to the shell assembly.

7. A support device for retaining a bicycle helmet on the head of a wearer said helmet having a shell assembly with a front and a back substantially covering a top portion of the head of a wearer comprising:

an arcuate arm for mounting on said back of the helmet so that the arm extends downwardly beyond the bottom rear edge of the helmet for engaging the back of the head of a wearer below the widest region of the head of a wearer, said arm being resiliently flexible to provide a resilient forward pressure against an inwardly curved portion on the posterior of a wearer's head; and a flexible connection including an elastic strap for connecting the lower end of said arm to opposite sides of a helmet; said arcuate arm being T-shaped with the top of the "T" inwardly curved in a lateral direction to extend around the posterior of a wearer's head.

8. A bicycle helmet comprising:

a shell assembly having a front portion and a back portion substantially covering the top portion of the head of a wearer;

an arcuate arm mounted on said back portion of the helmet so that the arm extends downwardly beyond the bottom rear edge of the helmet for engaging the back of the head of a wearer below the widest region of the head of a wearer;

an adjustable connection including an elastic strap for connecting the lower end of said arm to opposite sides of the helmet; and means for adjustably attaching the end of said arcuate arm mounted on the back of the helmet relative to the shell assembly.

9. A bicycle helmet comprising:

a shell assembly having a front portion and a back portion substantially covering the top portion only above the ears of the head of a wearer and a bottom edge;

an arcuate arm mounted on said back portion of the helmet so that the arm extends downwardly beyond the bottom rear edge of the helmet for continuously engaging the back of the head of a wearer below the widest region of the head of a wearer and free from direct engagement with any portion of said shell assembly other than where said arcuate arm is mounted on said shell assembly; and adjustable connection including an elastic strap for connecting the lower end of said arm to opposite sides of the helmet and a hook and loop type fastener forming an adjustable connection.

10. A bicycle helmet comprising:

a shell assembly having a front portion and a back portion substantially covering the top portion of the head of a wearer;

an arcuate arm mounted on said back portion of the helmet so that the arm extends downwardly beyond the bottom rear edge of the helmet for engaging the back of the head of a wearer below the widest region of the head of a wearer; and an adjustable connection including an elastic strap for connecting the lower end of said arm to opposite sides of the helmet;

said arcuate arm being T-shaped with the top of the "T" inwardly curved in a lateral direction to extend around the posterior of a wearer's head.

* * * * *